US010961895B2

(12) United States Patent
Higashino et al.

(10) Patent No.: US 10,961,895 B2
(45) Date of Patent: Mar. 30, 2021

(54) MUFFLER

(71) Applicant: FUTABA INDUSTRIAL CO., LTD., Okazaki (JP)

(72) Inventors: Tsuneyuki Higashino, Okazaki (JP); Katsuhiko Kainuma, Okazaki (JP); Takehiro Miura, Okazaki (JP); Shinnosuke Toichi, Okazaki (JP); Hayato Tawada, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 406 days.

(21) Appl. No.: 15/762,840

(22) PCT Filed: Jan. 17, 2017

(86) PCT No.: PCT/JP2017/001424
§ 371 (c)(1),
(2) Date: Mar. 23, 2018

(87) PCT Pub. No.: WO2017/126508
PCT Pub. Date: Jul. 27, 2017

(65) Prior Publication Data

US 2018/0266301 A1 Sep. 20, 2018

(30) Foreign Application Priority Data

Jan. 21, 2016 (WO) ..... PCT/JP2016/051710

(51) Int. Cl.
*F01N 13/08* (2010.01)
*F01N 1/02* (2006.01)
(Continued)

(52) U.S. Cl.
CPC ..... *F01N 13/08* (2013.01); *F01N 1/02* (2013.01); *F01N 1/023* (2013.01); *G10K 11/161* (2013.01);
(Continued)

(58) Field of Classification Search
CPC . F01N 1/02; F01N 1/026; F01N 1/023; F01N 2490/20; F01N 13/08;
(Continued)

(56) References Cited

U.S. PATENT DOCUMENTS 3,414,078 A 12/1968 Andersson
3,429,397 A * 2/1969 Case ..... F01N 1/006 181/227
(Continued)

FOREIGN PATENT DOCUMENTS

CN 102575539 A 7/2012
CN 104903556 A 9/2015
(Continued)

OTHER PUBLICATIONS

International Search Report for International Patent Application No. PCT/JP2016/051710 (Form PCT/ISA/210), dated Apr. 19, 2016 (2 pages).
(Continued)

*Primary Examiner* — Jeremy A Luks
(74) *Attorney, Agent, or Firm* — Withrow & Terranova, P.L.L.C.; Vincent K. Gustafson

(57) ABSTRACT

A muffler includes an inner pipe and an outer pipe which, along with the inner pipe, forms a double-wall pipe. A cavity is provided between the inner and outer pipes. A first end of the double-wall pipe is closed between the inner and outer pipes, and a second end of the double-wall pipe has an opening between the inner and outer pipes. The cavity communicates with an exhaust channel via the opening. The cavity is formed as a result of the inner pipe being shaped in a manner such that a portion of an outer-circumferential surface of the inner pipe is positioned on an inner-circum-
(Continued)

ferential side relative to a reference, the reference being a position of an outer-circumferential surface of the outer pipe.

39 Claims, 10 Drawing Sheets

(51) Int. Cl.
*G10K 11/16* (2006.01)
*G10K 11/172* (2006.01)

(52) U.S. Cl.
CPC ..... *G10K 11/172* (2013.01); *F01N 2470/08* (2013.01); *F01N 2470/10* (2013.01); *F01N 2470/24* (2013.01); *F01N 2490/20* (2013.01)

(58) Field of Classification Search
CPC ..... F01N 2470/08; F01N 2470/10; F01N 2470/24; G10K 11/161; G10K 11/172
See application file for complete search history.

(56) References Cited

U.S. PATENT DOCUMENTS

| | | | | |
|---|---|---|---|---|
| 3,543,878 | A | 12/1970 | Hamilton | |
| 4,143,739 | A | 3/1979 | Nordlie | |
| 6,467,261 | B1 * | 10/2002 | Hisanaga | F01N 13/08 138/112 |
| 8,607,923 | B2 * | 12/2013 | Takagaki | F01N 1/02 181/249 |
| 9,593,607 | B2 * | 3/2017 | Das | F01N 1/06 |
| 2012/0168245 | A1 | 7/2012 | Wakatsuki et al. | |
| 2015/0337699 | A1 | 11/2015 | Kainuma et al. | |

FOREIGN PATENT DOCUMENTS

| | | | |
|---|---|---|---|
| EP | 1099829 | A2 | 5/2001 |
| EP | 2520775 | A1 | 11/2012 |
| JP | S51029122 | U | 3/1976 |
| JP | S5411713 | U | 1/1979 |
| JP | S54117913 | U | 8/1979 |
| JP | S556436 | U | 1/1980 |
| JP | S57113919 | A | 7/1982 |
| JP | S57142119 | U | 9/1982 |
| JP | S58202320 | A | 11/1983 |
| JP | H08150412 | A | 6/1996 |
| JP | 2000154715 | A | 6/2000 |
| JP | 2001221046 | | 8/2001 |
| JP | 2001221046 | A | 8/2001 |
| JP | 2005105918 | A | 4/2005 |
| JP | 2008240723 | A | 10/2008 |
| JP | 2009203804 | A | 9/2009 |
| JP | 2014134180 | A | 7/2014 |
| KR | 20090013186 | U | 12/2009 |
| WO | 2011161042 | A1 | 12/2011 |

OTHER PUBLICATIONS

International Search Report for International Patent Application No. PCT/JP2017/001424 (Form PCT/ISA/210), dated Feb. 28, 2017 (2 pages).
Notification of Transmittal of Translation of the International Preliminary Report on Patentability, and International Preliminary Report on Patentability (Chapter I of Patent Cooperation Treaty) for International Application No. PCT/JP2017/001424 (Forms PCT/IB/338, PCT/IB/373, and PCT/ISA/237), dated Aug. 2, 2018 (9 pages).
Notification of Transmittal of Translation of the International Preliminary Report on Patentability, and International Preliminary Report on Patentability (Chapter I of Patent Cooperation Treaty) for International Application No. PCT/JP2016/051710 (Forms PCT/IB/326, PCT/IB/373, and PCT/ISA/237), dated Aug. 2, 2018 (8 pages).
Notification of Reasons for Refusal for Japanese Patent Application No. 2017-562822, dated Oct. 16, 2018, 7 pages.
Examination Report for Indian Patent Application No. 201837010919, dated Jan. 29, 2020, 6 pages.
Notification of Reasons for Refusal for Japanese Patent Application No. 2017-562822, dated Mar. 12, 2019, 9 pages.
Office Action for Canadian Patent Application No. 3011575, dated Apr. 3, 2019, 6 pages.
Decision of Refusal for Japanese Patent Application No. 2017-562822 dated Oct. 23, 2019 (6 pages including English translation).
Notice of Reasons for Refusal for Japanese Patent Application No. 2020007472, dated Dec. 22, 2020, 6 pages.
Search Report for Japanese Patent Application No. 2020007472, dated Dec. 23, 2020, 19 pages.
Notice of Reasons for Refusal for Japanese Patent Application No. 2020007473, dated Jan. 5, 2021, 6 pages.
Search Report for Japanese Patent Application No. 2020007473, dated Dec. 23, 2020, 21 pages.

* cited by examiner 5
11
13
17
17A
17B
19
21
23
15
15A
15B
IIB
IIC
IID
R1
R2
R3
R4
A1

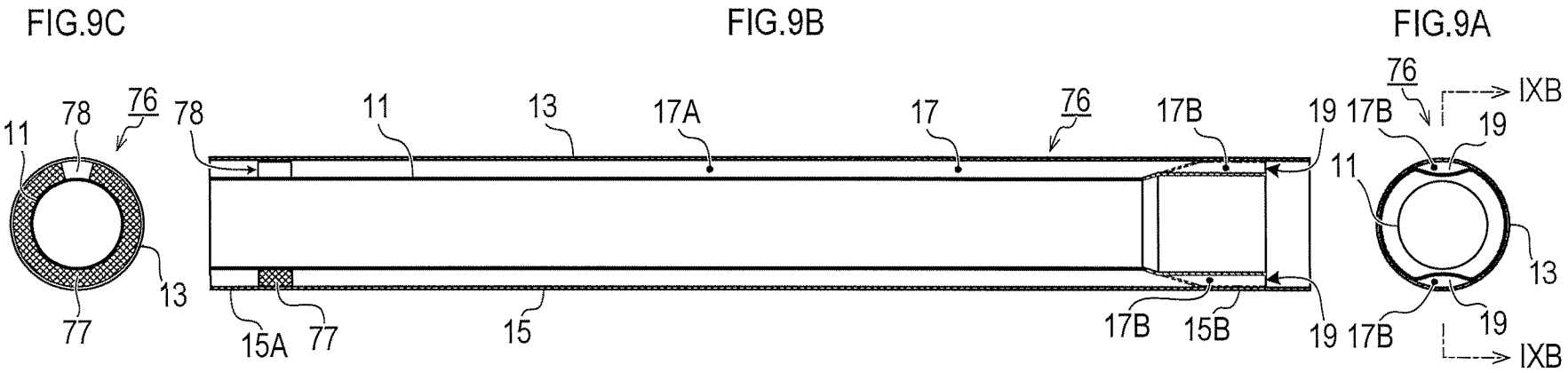
FIG.9A
FIG.9B
FIG.9C
IXB
IXB
76
17B
19
13
11
15B
17
17A
15
77
15A
78
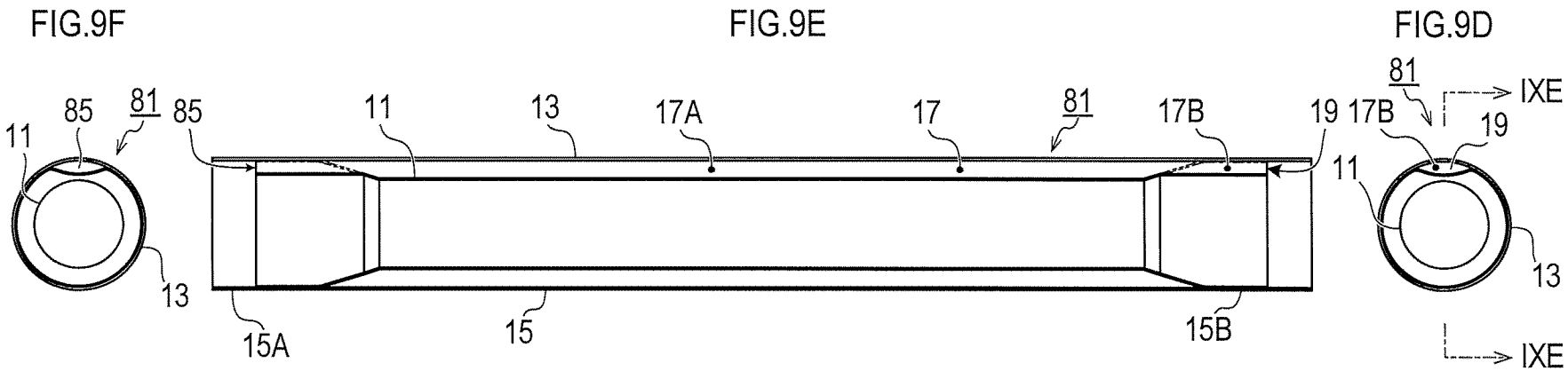
FIG.9D
FIG.9E
FIG.9F
IXE
IXE
81
17B
19
13
11
15B
17
17A
15
15A
85

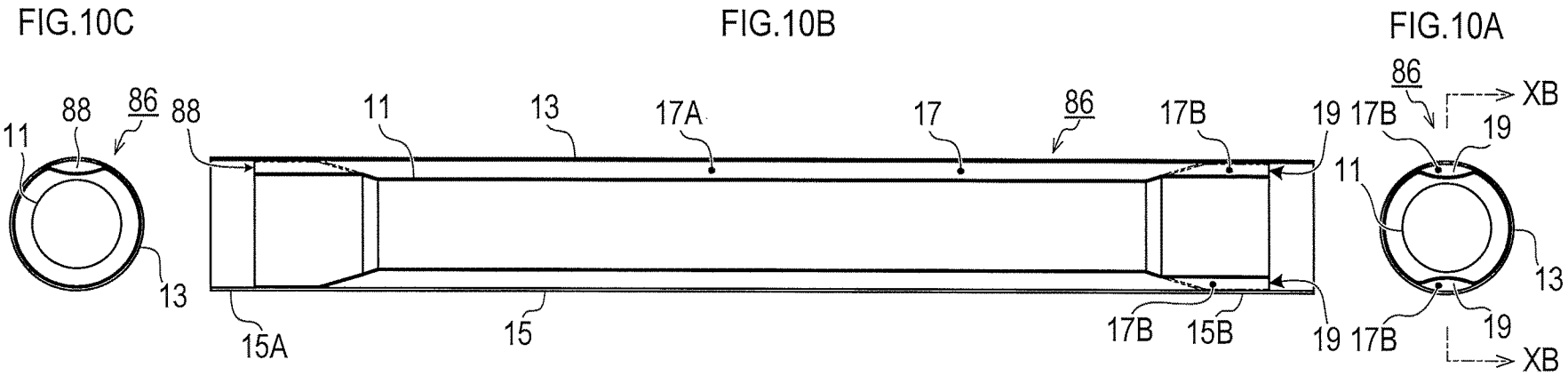
FIG.10A
FIG.10B
FIG.10C
XB
XB
86
19
17B
11
13
15
15A
17
17A
88
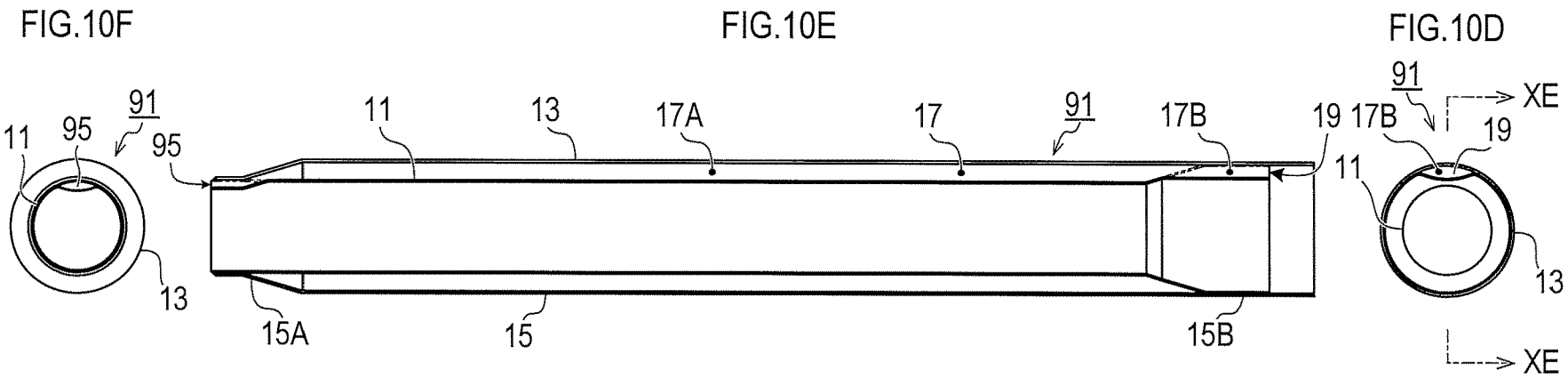
FIG.10D
FIG.10E
FIG.10F
XE
XE
91
19
17B
11
13
15
15A
17
17A
95

MUFFLER

CROSS-REFERENCE TO RELATED APPLICATION(S)

This application is a 35 U.S.C. § 371 national phase filing of International Application No. PCT/JP2017/001424 filed Jan. 17, 2017 in the Japan Patent Office, which claims benefit of International Application No. PCT/JP2016/051710 filed Jan. 21, 2016 in the Japan Patent Office, wherein the disclosures of the foregoing applications are hereby incorporated by reference herein in their entireties.

TECHNICAL FIELD

The present disclosure relates to a muffler.

BACKGROUND ART

A known exhaust system for automobile is provided with a sub-muffler between a catalyst disposed upstream of an exhaust channel and a main muffler disposed downstream of the exhaust channel (see, for example, Patent Document 1). The sub-muffler described in Patent Document 1 has a double-wall pipe including an outer pipe and an inner pipe, and the inner pipe has a plurality of small holes.

PRIOR ART DOCUMENTS

Patent Documents

Patent Document 1: Japanese Patent Application Publication No. 2000-154715

SUMMARY OF THE INVENTION

Problems to be Solved by the Invention

If the inner pipe, provided with the plurality of small holes as described above, is bent, the small holes are easily deformed. There is a a problem of poor processability such that bending can be performed only within a range in which excessive deformation does not occur. Therefore, depending on a degree of bending of a bent portion of an exhaust pipe, it is sometimes difficult to provide the sub-muffler in the bent portion.

Also, since the outer pipe is shaped so as to bulge out largely, a place to arrange the sub-muffler is also limited. In some cases, the sub-muffler cannot be arranged in a desired place.

In view of the circumstances as described above, it is desirable to provide a muffler configured to have good bending processability and easy to downsize.

Means for Solving the Problems

The muffler to be described below includes an inner pipe and an outer pipe. Each of the inner pipe and the outer pipe has a tubular shape. The inner pipe is disposed on an inner-circumferential side of the outer pipe. The outer pipe forms a double-wall pipe together with the inner pipe. One of a first end which is one end of the double-wall pipe and a second end which is the other end of the double-wall pipe is continuous with a first channel on an upstream side in an exhaust flow direction, and the other is continuous with a second channel on a downstream side in the exhaust flow direction. Thereby, it is possible to form an exhaust channel coupling the first channel and the second channel via the inner pipe. A cavity is provided between the inner pipe and the outer pipe. At least one of the first end and the second end has an opening between the inner pipe and the outer pipe, so that the cavity communicates with the exhaust channel via the opening. The inner pipe has a portion shaped such that a part of an outer-circumferential surface of the inner pipe is positioned on the inner-circumferential side relative to a reference, the reference being a position of an inner-circumferential surface of the outer pipe. The cavity is formed between the portion and the inner-circumferential surface of the outer pipe.

According to the muffler configured as above, a cavity is provided between the inner pipe and the outer pipe forming the double-wall pipe, at least one of the first end and the second end is open between the inner pipe and the outer pipe, and the cavity communicates with the exhaust channel via the opening. If there is such cavity, it is possible to form a Helmholtz resonator, for example, by utilizing the cavity and produce a muffling effect. Alternatively, for example, the cavity can be made to function as a side branch so as to produce a muffling effect.

With the muffler having the above configuration, it is not necessary to provide small holes in the inner pipe, unlike a muffler having a plurality of small holes in an inner pipe. Therefore, the inner pipe of the muffler of the present disclosure can be bent without necessity of considering deformation of the small holes. The muffler of the present disclosure can ensure better bending processability than a muffler utilizing an inner pipe having small holes. The muffler of the present disclosure can be disposed even at a bent portion of the exhaust pipe, so that a place with a higher muffling effect can be selected. Therefore, the muffler of the present disclosure can more appropriately exhibit a muffling effect than a muffler which is difficult to dispose at a bent portion of an exhaust pipe.

In addition, the inner pipe has a portion shaped such that a part of the outer-circumferential surface of the inner pipe is positioned on the inner-circumferential side relative to a reference, the reference being a position of the inner-circumferential surface of the outer pipe. The cavity is formed between the portion and the inner-circumferential surface of the outer pipe. Therefore, according to the muffler of the present disclosure, it is possible to further reduce an outer diameter of the double-wall pipe as compared to a case in which a cavity ensured, for example, only by inflating the outer pipe to an outer-circumferential side. It becomes possible to dispose the muffler even in a narrower arrangement place. The muffler of the present disclosure increases a degree of freedom for determining where to place the muffler so as to allow selection of a place with a higher muffling effect. Therefore, the muffler of the present disclosure can more appropriately exhibit a muffling effect as compared to a large muffler having a limited arrangement place.

If one of the first end and the second end has an opening between the inner pipe and the outer pipe, the other end may have an opening between the inner pipe and the outer pipe, or may be closed between the inner pipe and the outer pipe. If the other end is closed between the inner pipe and the outer pipe, the cavity between the inner pipe and the outer pipe may be closed in any manner. Some of the measures to close the cavity can include, for example, welding the inner pipe and the outer pipe, and inserting an inclusion between the inner pipe and the outer pipe.

Further, the first end of the muffler may or may not be completely sealed, as long as the first end is closed between the inner pipe and the outer pipe to an extent such that a muffling effect due to the cavity is achieved. That is, there is no need for the first end of the muffler to have an airtight sealed configuration between the inner pipe and the outer pipe. Somewhat breathable inclusion (such as, for example, a wire mesh) may be inserted between the inner pipe and the outer pipe to close between the inner pipe and the outer pipe.

BRIEF DESCRIPTION OF THE DRAWINGS

FIG. 9A is an explanatory view of a sub-muffler of a twelfth embodiment as seen from the second end, FIG. 9B is a cross-sectional view taken along a line IXB-IXB in FIG. 9A, FIG. 9C is an explanatory view of a sub-muffler of a twelfth embodiment as seen from the first end, FIG. 9D is an explanatory view of a sub-muffler of a thirteenth embodiment as seen from the second end, FIG. 9E is a cross-sectional view taken along a line IXE-IXE in FIG. 9D, and FIG. 9F is an explanatory view of a sub-muffler of a thirteenth embodiment viewed from the first end.

FIG. 10A is an explanatory view showing a sub-muffler of a fourteenth embodiment as seen from the second end, FIG. 10B is a cross-sectional view taken along a line XB-XB in FIG. 10A, FIG. 10C is an explanatory view of a sub-muffler of a fourteenth embodiment as viewed from the first end, FIG. 10D is an explanatory view of a sub-muffler of a fifteenth embodiment as seen from the second end, FIG. 10E is a cross-sectional view taken along a line XE-XE in FIG. 10D, and FIG. 10F is an explanatory view of a sub-muffler of a fifteenth embodiment as seen from the first end.

EXPLANATION OF REFERENCE NUMERALS

1, 31, 41 . . . exhaust system, 3 . . . catalytic converter, 5, 61, 61, 76, 81, 86, 91 . . . sub-muffler, 5A . . . first sub-muffler, 5B . . . second sub-muffler, 7 . . . main muffler, 9, 9A, 9B, 9C, 9D . . . pipe member, 11 . . . inner pipe, 13 . . . outer pipe, 15 . . . double-wall pipe, 15A . . . first end, 15B . . . second end, 17, 63 . . . cavity, 17A . . . resonance chamber, 17B . . . resonance pipe, 19, 78, 88, 95 . . . opening, 21 . . . large diameter portion, 23 . . . small diameter portion, 53, 77 . . . wire mesh.

MODE FOR CARRYING OUT THE INVENTION

Hereinafter, the muffler described above will be described with example embodiments.

(1) First Embodiment

[Configuration of Exhaust System]

Figure 1:
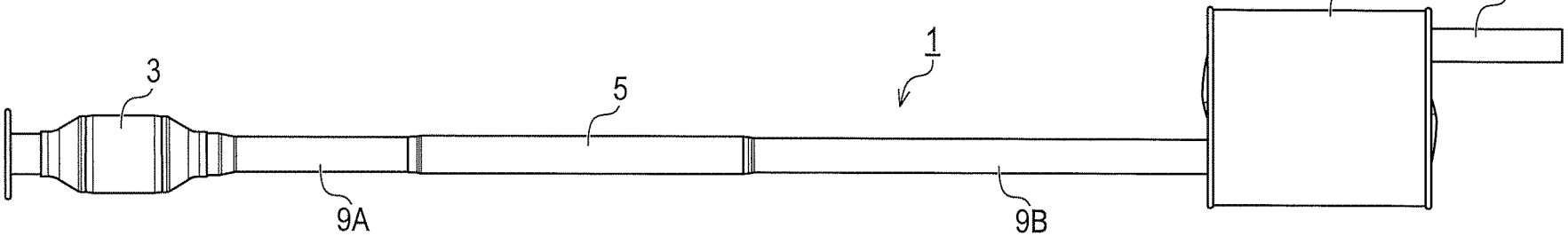
FIG. 1 is a plan view showing an exhaust system of a first embodiment.

An exhaust system 1 shown in FIG. 1 includes a catalytic converter 3, a sub-muffler 5A, a main muffler 7, and pipe members 9A, 9B, 9C (hereinafter also referred to as pipe members 9 when individual pipe members are not distinguished from each other). These components are coupled in series. The catalytic converter 3 is a device that purifies exhaust gas, and includes a catalyst therein. The sub-muffler 5, and the main muffler 7 are both devices that reduce exhaust noise. Among these components, the sub-muffler 5 corresponds to an example of a muffler of the present disclosure.

Figures 2A, 2B, 2C, 2D:
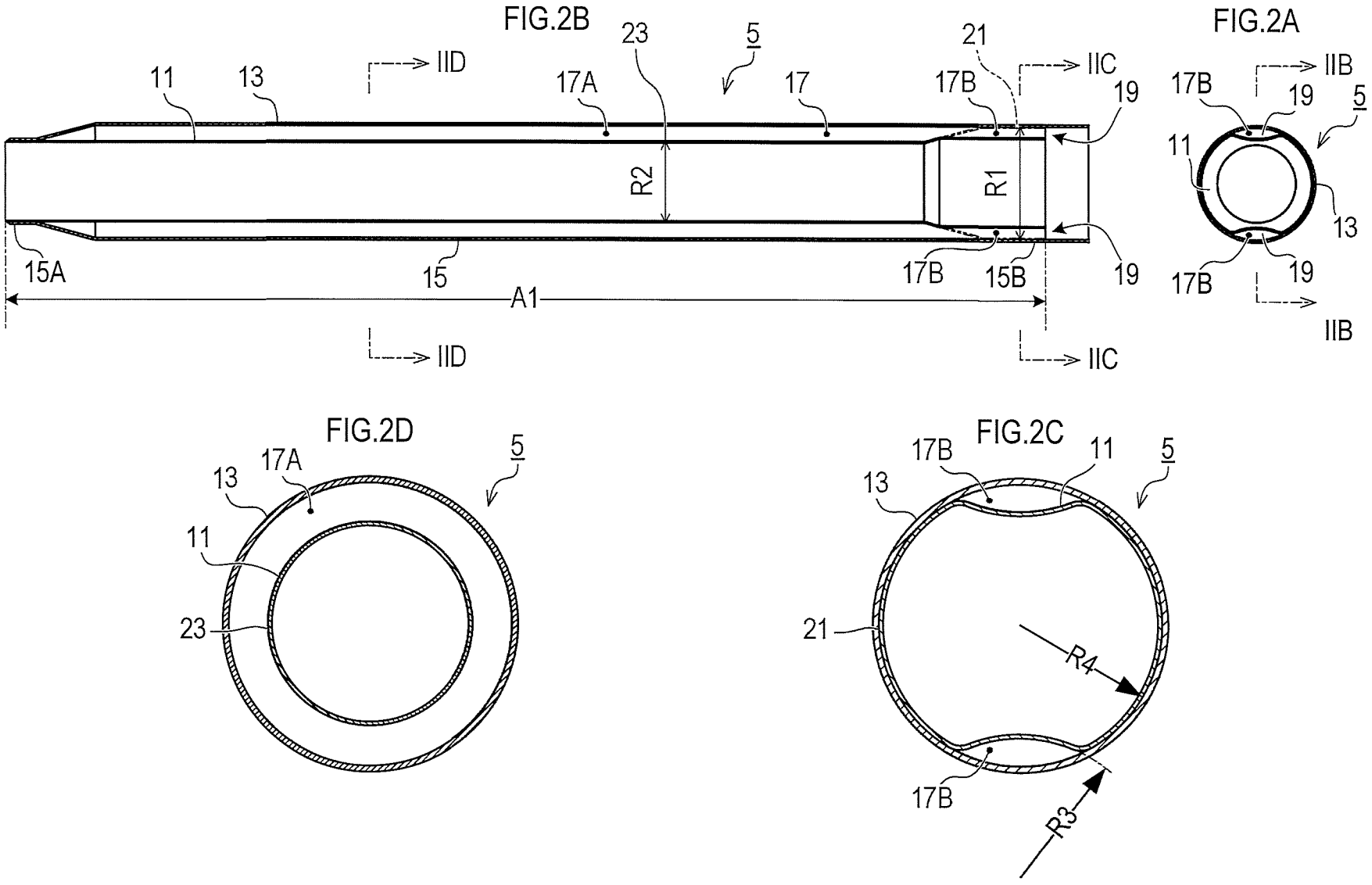
FIG. 2A is an explanatory view of a sub-muffler of the first embodiment as seen from a second end.
FIG. 2B is a cross-sectional view taken along a line IIB-IIB in FIG. 2A.
FIG. 2C is an enlarged cross-sectional end view taken along a line IIC-IIC in FIG. 2B.
FIG. 2D is an enlarged cross-sectional end view taken along a line IID-IID in FIG. 2B.

As shown in FIGS. 2A and 2B, the sub-muffler 5 includes an inner pipe 11 and an outer pipe 13. Each of the inner pipe 11 and the outer pipe 13 has a tubular shape. The inner pipe 11 is disposed on an inner-circumferential side of the outer pipe 13, whereby the inner pipe 11 and the outer pipe 13 form a double-wall pipe 15 in a range A1 shown in FIG. 2B. In the following description, one end (left end in FIG. 2B) of the double-wall pipe 15 is referred to as a first end 15A, and the other end (right end in FIG. 2B) is referred to as a second end 15B.

The above-mentioned pipe members 9A and 9B are coupled to the first end 15A and the second end 15B, respectively. As a result, an inner circumferential side of the inner pipe 11 is continuous with a first channel on an upstream side in an exhaust flow direction at the first end 15A. Further, an inner circumferential side of the outer pipe 13 is continuous with a second channel on a downstream side in the exhaust flow direction at the second end 15B. That is, an exhaust channel that couples the first channel and the second channel is configured via the inner pipe 11.

Either of the first end 15A and the second end 15B may be on an upstream side of the exhaust channel. Specifically, the second end 15B may be continuous to the first channel on the upstream side in the exhaust flow direction and the first end 15A may be continuous to the second channel on the downstream side in the exhaust flow direction. In addition, separate bodies of the pipe members 9A, 9B may be joined to the inner pipe 11 and the outer pipe 13, or the inner pipe 11 and the outer pipe 13 themselves may be integrally molded up to portions corresponding to the pipe members 9A, 9B.

A cavity 17 is provided between the inner pipe 11 and the outer pipe 13. More specifically, as shown in FIG. 2B, the inner pipe 11 has a large-diameter portion 21 having a first diameter R1 as a maximum outer diameter and a small-diameter portion 23 having a second diameter R2 as a maximum outer diameter smaller than the first diameter R1. The large-diameter portion 21 is disposed at the second end 15B side, and the small-diameter portion 23 is disposed at the first end 15A side. The outer pipe 13 is configured to have an inner diameter substantially the same as the maximum outer diameter of the inner pipe 11 in the most range continuous from the second end 15B. However, the outer pipe 13 is shaped such that its outer diameter is narrowed down only in part near the first end 15A so as to become smaller toward the first end 15A side as shown in FIG. 2B.

As a result that the inner pipe 11 and the outer pipe 13 are formed in the above-described shape, a resonance chamber 17A, that corresponds to a part of the cavity 17, is formed between an outer-circumferential surface of the small-diameter portion 23 and an inner-circumferential surface of the outer pipe 13. In the large-diameter portion 21, as shown in FIG. 2C, a part of an outer-circumferential surface of the inner pipe 11 is recessed toward the inner-circumferential side. As a result, a resonance pipe 17B corresponding to a part of the cavity 17 is formed between a part of an outer-circumferential surface of the large diameter portion 21 and the inner-circumferential surface of the outer pipe 13.

That is, in a portion forming the resonance chamber 17A and the resonance pipe 17B, the inner pipe 11 is shaped such that a part of the outer circumferential surface of the inner pipe 11 is disposed on an inner-circumferential side relative to a reference, the reference being a position of the inner-circumferential surface of the outer pipe 13. As a result, the resonance chamber 17A and the resonance pipe 17B as described above are formed between a part of the outer-circumferential surface of the inner pipe 11 and the inner-circumferential surface of the outer pipe 13.

In the present embodiment, a center of curvature of the recess on the outer circumferential surface of the inner pipe 11 provided in a position forming the resonance pipe 17B is on the outer circumference side of the inner pipe 11. Further, a radius of curvature R3 of the recess is approximately the same as a maximum radius R4 of the inner pipe 11 (that is, a radius of a portion without a recess). This can make a circumferential length of a pipe substantially the same before and after processing upon forming a recess by post-processing for a pipe having a circular cross section, so that it is possible to form a recess while substantially maintaining a pipe thickness. However, whether to form such recess by post-processing can be freely selected. A pipe formed into a recessed shape in advance may be used.

At the first end 15A, the inner pipe 11 and the outer pipe 13 are positioned in contact with each other. Thus, a space between the inner pipe 11 and the outer pipe 13 is closed. In the present embodiment, the inner pipe 11 and the outer pipe 13 are welded over the entire circumference at the first end 15A. On the other hand, at the second end 15B, there is an opening 19 between the inner pipe 11 and the outer pipe 13. This opening 19 is located at one end of the resonance pipe 17B described above, and the resonance pipe 17B communicates with the exhaust channel via the opening 19. The other end of the resonance pipe 17B communicates with the resonance chamber 17A, and the resonance chamber 17A communicates with the exhaust channel via the resonance pipe 17B.

The resonance pipe 17B and the resonance chamber 17A provided as described above are configured to function as a Helmholtz resonator. More specifically, as shown in FIG. 2D, the resonance chamber 17A has a larger cross-sectional area (perpendicular to an axial direction of the outer pipe 13) than the resonance pipe 17B and a longer length (parallel to the axial direction of the outer pipe 13) than the resonance pipe 17B. Thus, the resonance chamber 17A has a much larger volume than the resonance pipe 17B. On the other hand, as shown in FIG. 2C, the resonance pipe 17B has a smaller cross sectional area perpendicular to the axial direction of the outer pipe 13 than the resonance chamber 17A.

[Effects]

According to the sub-muffler 5 configured as described above, the cavity 17 is provided between the inner pipe 11 and the outer pipe 13 that form the double-wall pipe 15. At the second end 15B, the opening 19 is provided between the inner pipe 11 and the outer pipe 13, and the cavity communicates with the exhaust channel via the opening 19. Consequently, in the present embodiment, the resonance pipe 17B and the resonance chamber 17A function as a Helmholtz resonator, so that a muffling effect is produced.

With the sub-muffler 5 having such configuration, it is unnecessary to provide small holes in the inner pipe 11. Thus, the inner pipe 11 can be bent without necessity of considering deformation of such small holes. Therefore, better bending processability is ensured as compared to a case of the inner pipe 11 having small holes. Accordingly, the sub-muffler 5 can be arranged even at a bent portion of the exhaust pipe, so that it is possible to select a place with a higher muffling effect. As compared to a sub-muffler 5 which is difficult to dispose at a bent portion of the exhaust pipe, a muffling effect can be more appropriately exhibited.

In addition, the cavity 17 as described above is formed by shaping the inner pipe 11 such that a part of the outer-circumferential surface of the inner pipe 11 is located on the inner-circumferential side relative to a reference, the reference being the position of the inner-circumferential surface of the outer pipe 13. Therefore, for example, the outer diameter of the double-wall pipe 15 can be made smaller as compared to a case in which the cavity 17 is ensured only by inflating the outer pipe 13 toward the outer-circumferential side. The sub-muffler 5 can be disposed even in a narrower arrangement place. Therefore, a degree of freedom in determining where to dispose the sub-muffler 5 is increased and a place with a higher muffling effect can be selected, so that a muffling effect can be more appropriately exhibited as compared to a large sub-muffler 5 with the limited arrangement place.

In the sub-muffler 5 described above, the opening 19 is provided at the second end 15B of the double-wall pipe 15 to form the resonance pipe 17B extending in the same direction as the axial direction of the double-wall pipe 15.

Therefore, compared to a case of a through hole penetrating penetrating the inner pipe 11 in a radial direction as a resonance pipe, an axial length of the resonance pipe 17B can be easily lengthened. A resonance frequency f in the Helmholtz resonator can be calculated by a mathematical expression (1) below based on a sound velocity C, a resonance pipe cross-sectional area S, a resonance pipe length L, and a resonance chamber volume V.

[Expression 1]

$$f = \frac{C}{2\cdot\pi}\sqrt{\frac{S}{V\cdot L}} \tag{1}$$

Therefore, if the axial length L of the resonance pipe 17B can be increased, the resonance frequency f can be set low. On the other hand, when a through hole penetrating the inner pipe 11 in the radial direction (that is, a thickness direction of the inner pipe 11) is used as a resonance pipe, the resonance pipe length L is at most a wall thickness of the inner pipe 11. Here, as a way to reduce the resonance frequency f, the cross-sectional area S of the resonance pipe may be reduced. However, the reduced cross-sectional area S of the resonance pipe weakens a muffling effect itself even if the resonance frequency f can be reduced. Although it is possible to couple a pipe to the through hole of the inner pipe 11 to extend the resonance pipe length L, a complicated configuration is produced due to the addition of the pipe, leading to reduced productivity and increased size of the whole configuration. In this respect, the configuration like the sub-muffler 5 allows the axial length of the resonance pipe 17B to be easily set to a desired length. Thus, it is possible to easily reduce resonance frequency while ensuring a sufficient noise suppressing effect. Also, it is possible to reduce exhaust noise of target frequency.

In the sub-muffler 5 described above, the outer pipe 13 has a shape such that an outer diameter in the range from the first end 15A to the second end 15B is equal to or smaller than the outer diameter of the outer pipe 13 at the second end 15B. Therefore, the sub-muffler 5 can be also disposed in a narrower arrangement place, as compared to a sub-muffler 5 having a portion with a larger outer diameter of the double-wall pipe 15 than that at the second end 15B.

[Modification Example of Shape of Resonance Pipe 17B]

In the first embodiment, FIG. 2C shows that the resonance pipe 17B is formed by providing a recess convex toward the inner circumferential side at both upper and lower portions of the inner pipe 11. However, the number of the resonance pipes 17B, and the shape of the recess provided on the outer circumference of the inner pipe 11 to form the resonance pipe 17B, are not limited to those of the above example.

Figure 3A:
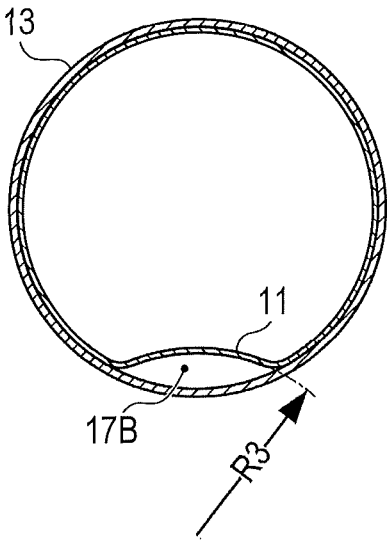
FIG. 3A is a cross-sectional end view showing a first modification of the section shown in FIG. 2C.

For example, as shown in FIG. 3A, a resonance pipe 17B having the same shape as the resonance pipe 17B shown in FIG. 2C may be provided only at a lower side of the inner pipe 11. A similar resonance pipe 17B may be provided in a position other than the lower side of the inner pipe 11. However, in case of dew condensation on the inner-circumferential surface of the outer pipe 13 resulting in water accumulation inside the outer pipe 13 (for example, inside the resonance chamber 17A), the resonance pipe 17B provided at the lower side of the inner pipe 11 may be able to discharge the water to the outside via the resonance pipe 17B. Therefore, in consideration of such advantage, it is preferable that the resonance pipe 17B is formed at least at the lower side of the inner pipe 11. However, another drainage measure can be employed for the water inside the outer pipe 13, so it is not indispensable to provide the resonance pipe 17B at the lower side of the inner pipe 11.

Figure 3B:
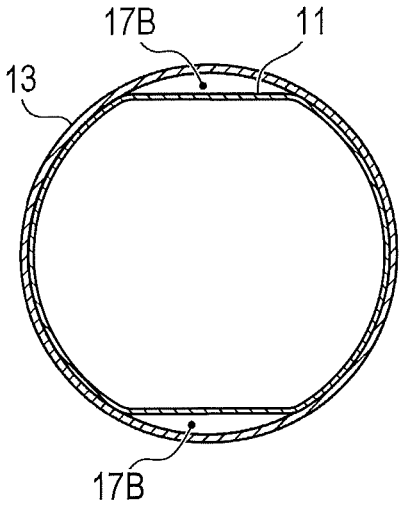
FIG. 3B is a cross-sectional end view showing a second modification of the section shown in FIG. 2C.

In addition, as shown in FIG. 3B, a flat portion may be provided on both the upper and lower portions of the inner pipe 11 so as to form the resonance pipe 17B. If a reference is a position where the entire outer-circumferential surface of the inner pipe 11 contacts the inner-circumferential surface of the outer pipe 13, even the flat portions as such are positioned closer to the inner-circumferential side than the reference, so that the resonance pipe 17B can be formed.

Figure 3C:
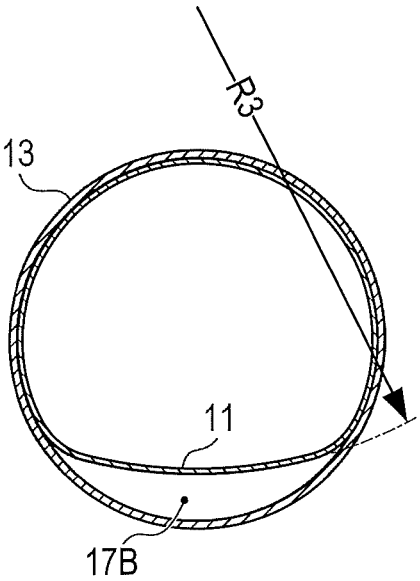
FIG. 3C is a cross-sectional end view showing a third modification of the section shown in FIG. 2C.
Figure 3D:
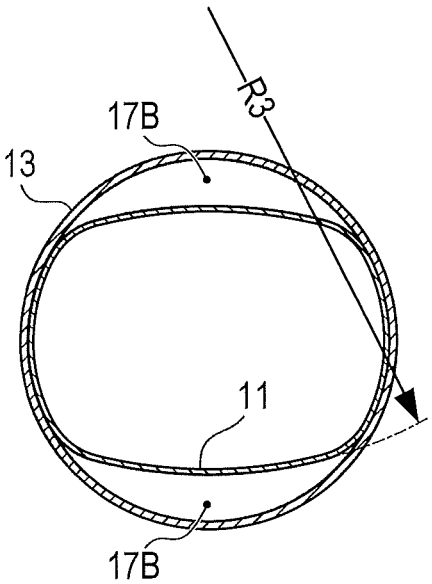
FIG. 3D is a cross-sectional end view showing a fourth modification of the section shown in FIG. 2C.

Further, as shown in FIG. 3C, a portion convex toward the outer circumference side may be provided in a lower position of the inner pipe 11 so as to form the resonance pipe 17B. If a reference is the position where the entire outer circumferential surface of the inner pipe 11 contacts the inner circumferential surface of the outer pipe 13, the portion convex toward the outer circumferential side is arranged on the inner-circumferential side relative to the reference so that the resonance pipe 17B can be formed. As shown in FIG. 3D, the portion convex toward the outer circumferential side may be provided at both the upper and lower portions of the inner pipe 11 so as to form the resonance pipe 17B. As shown in FIGS. 3C and 3D, a center of curvature of such convex portion is also on the outer-circumferential side of the inner pipe 11.

(2) Second Embodiment

Next, a second embodiment will be described. The second embodiment and the subsequent embodiments will be described, focusing on differences from the first embodiment in detail. For components similar to those in the first embodiment, the same reference numerals as in the first embodiment are used in the figures, and a detailed description thereof will not be repeated.

Figure 4A:
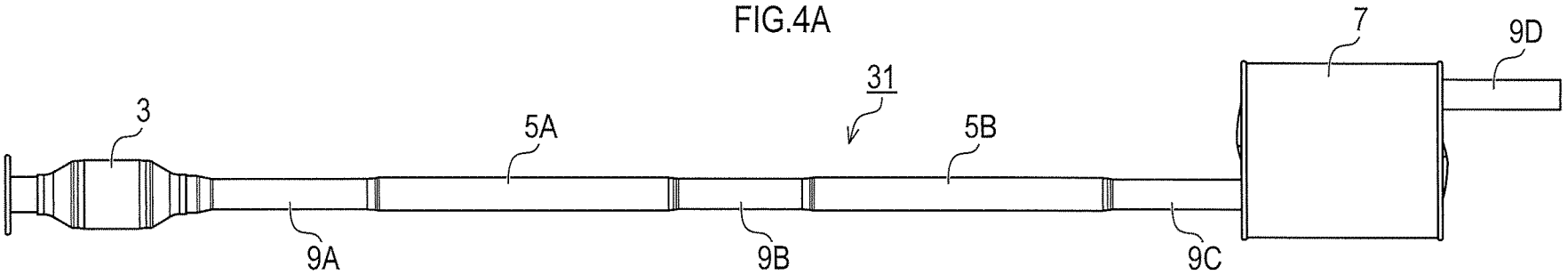
FIG. 4A is a plan view showing an exhaust system of a second embodiment.

An exhaust system 31 shown in FIG. 4A includes the catalytic converter 3, a first sub-muffler 5A, a second sub-muffler 5B, the main muffler 7, and pipe members 9A, 9B, 9C, 9D. These components are coupled in series. That is, the second embodiment is different from the first embodiment in that there are two sub-mufflers.

Such configuration can reduce exhaust noise by disposing the second sub-muffler 5B at an antinode in sound pressure of a standing wave generated by air column resonance that occurs in the exhaust pipe, even if the first sub-muffler 5A alone cannot handle the air column resonance.

(3) Third Embodiment

A third embodiment will be described below.

Figure 4B:
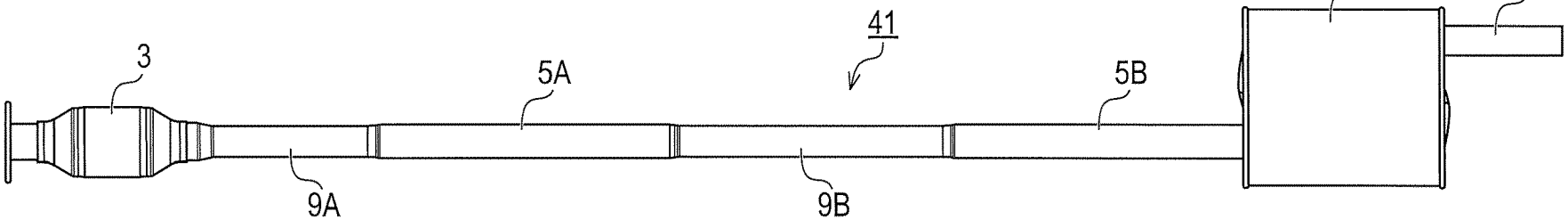
FIG. 4B is a plan view showing an exhaust system of a third embodiment.

An exhaust system 41 shown in FIG. 4B includes the catalytic converter 3, the first sub-muffler 5A, the second sub-muffler 5B, the main muffler 7, and the pipe members 9A, 9B, 9C. These components are coupled in series. This embodiment is similar to the second embodiment in that there are two sub-mufflers 5A and 5B.

However, in the third embodiment, one end of the second sub-muffler 5B is directly coupled to the main muffler 7. As above, the pipe members are not always coupled to both ends of the sub-muffler 5 corresponding to the muffler of the present disclosure. Various devices that can be configured as an exhaust channel may be directly coupled to the ends of the sub-muffler 5.

(4) Fourth Embodiment

Now, a fourth embodiment will be described.

Figure 5A:
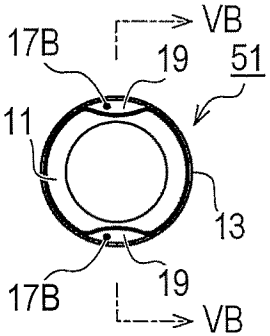
FIG. 5A is an explanatory view of a sub-muffler of a fourth embodiment as seen from a second end.
Figure 5B:
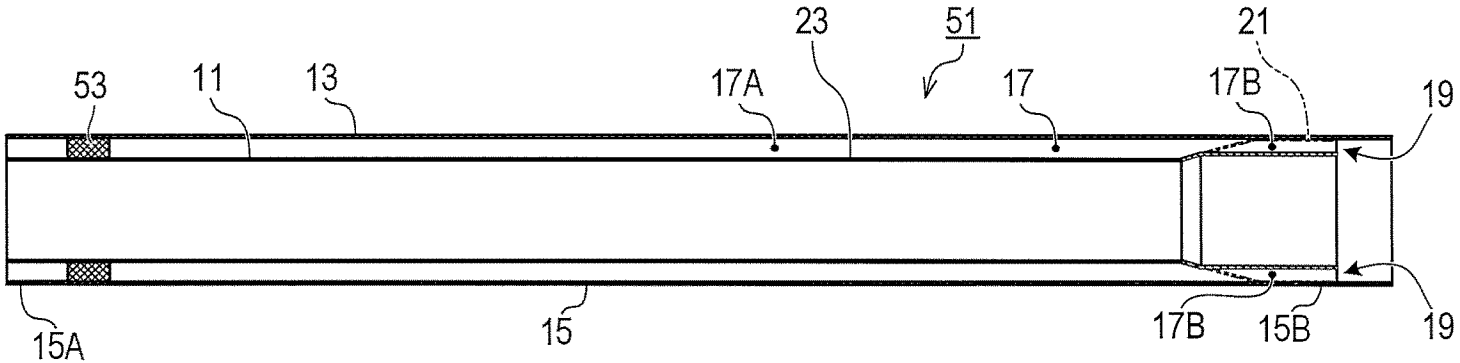
FIG. 5B is a cross-sectional view taken along a line VB-VB in FIG. 5A.
Figure 5C:
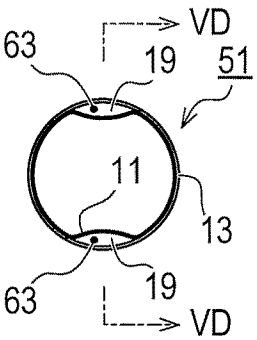
FIG. 5C is an explanatory view of a sub-muffler of a fifth embodiment as seen from the second end.

A sub-muffler 51 shown in FIG. 5A is not located at a position where the inner pipe 11 and the outer pipe 13 are in contact with each other at the first end 15A. Instead, a wire mesh 53, which is a metal cushioning member, is disposed between the inner pipe 11 and the outer pipe 13, so as to close the cavity between the inner pipe 11 and the outer pipe 13. As above, the cavity between the inner pipe 11 and the outer pipe 13 may be closed by other than welding.

Although not shown, an inclusion such as a wire mesh 53 may be inserted between the inner pipe 11 and the outer pipe 13 also at the second end 15B. At the second end 15B, however, since there is the above-described opening 19 so as to ensure a cavity to become the resonance pipe 17B, no inclusion is disposed in portions corresponding to the opening 19 and the resonance pipe 17B.

(5) Fifth Embodiment

A fifth embodiment will be described below.

Figure 5D:
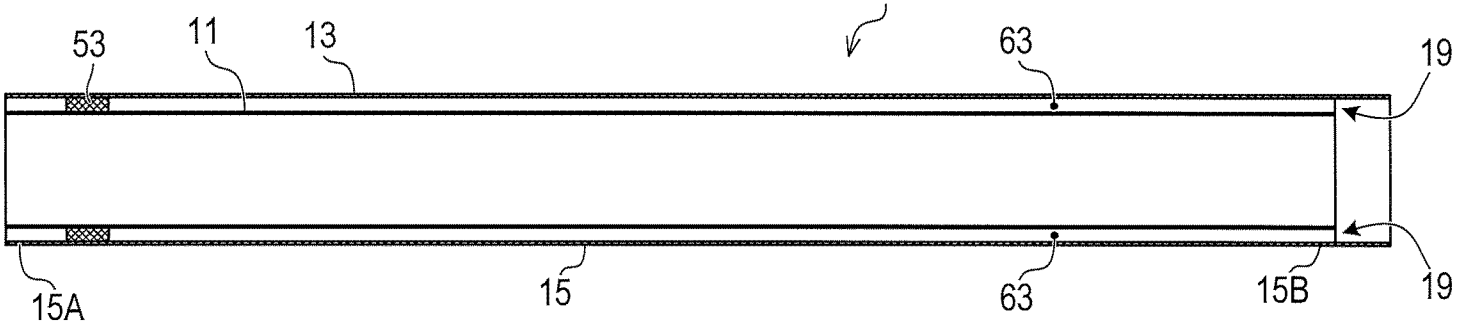
FIG. 5D is a cross-sectional view taken along a line VD-VD in FIG. 5C.

In a sub-muffler 61 shown in FIG. 5D, the shape of the inner pipe 11 is different from the shape in each of the above-described embodiments. A portion having a cross-sectional shape corresponding to the large diameter portion 21 in each of the above-described embodiments is continuous over the entire axial length of the inner pipe 11 so as to form a linear cavity 63 without the resonance chamber 17A. At the first end 15A, the wire mesh 53 is inserted between the inner pipe 11 and the outer pipe 13, so as to close the cavity between the inner pipe 11 and the outer pipe 13, as in the fourth embodiment. In the sub-muffler 61 configured as such, the cavity 63 functions as a side branch. That is, the muffler of the present disclosure can be configured not only as a Helmholtz resonator muffler, as shown in each of the embodiments from the first to the fourth embodiments, but also as a side branch muffler, as shown in the fifth embodiment.

(6) Sixth Embodiment

A sixth embodiment will now be described. The exhaust system 1 shown in FIG. 6A includes the same components as those of the exhaust system 1 described in the first embodiment described above. Exhaust gas discharged from an engine 71 flows into the catalytic converter 3 through an exhaust manifold 73. Further, in the sixth embodiment, the arrangement place of the sub-muffler 5 is optimized in consideration of a range in which air column resonance occurs in the exhaust system 1.

Figure 6A:
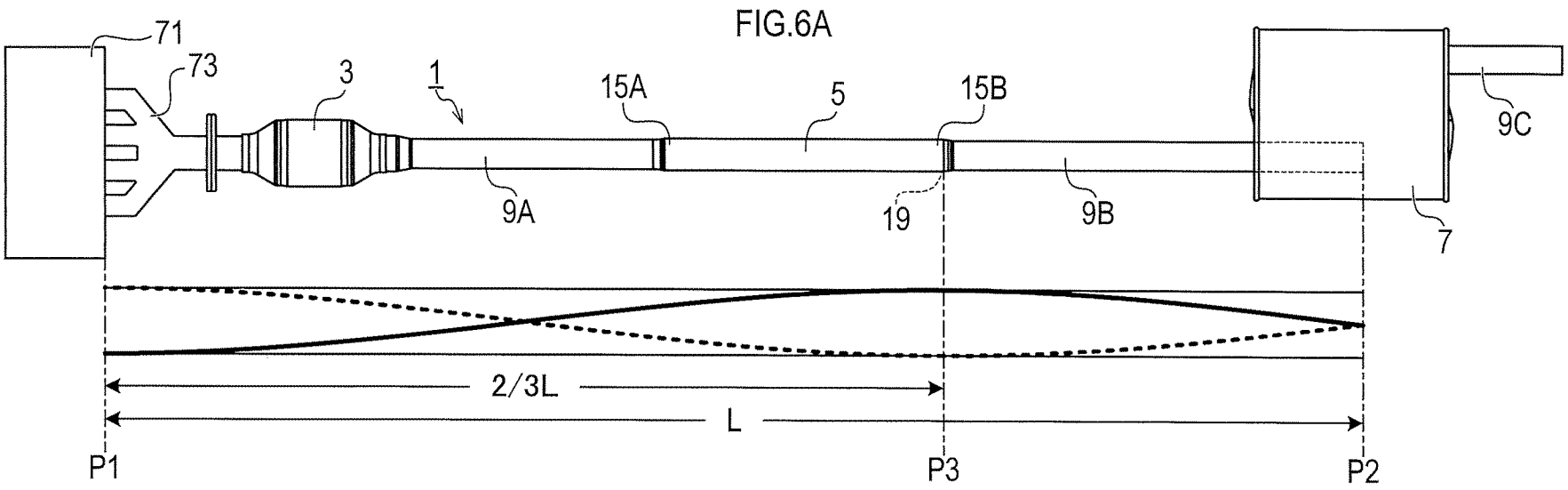
FIG. 6A is an explanatory view showing an exhaust system of a sixth embodiment, a range in which air column resonance occurs in the exhaust system, and positions of antinodes and nodes in sound pressure of a standing wave generated in the range.

More specifically, in the exhaust system 1 of the sixth embodiment, resonance sound caused by air column resonance is generated in an exhaust channel from a coupling point P1 between the engine 71 and the exhaust manifold 73 to an end P2 of the pipe member 9B (exhaust channel having a length L shown in FIG. 6A). FIG. 6A also shows a waveform representing sound pressure of a standing wave generated in the exhaust channel upon air column resonance. In the exhaust system 1 of the sixth embodiment, the sub-muffler 5 is arranged so that the opening 19 is provided in a position corresponding to an antinode in sound pressure of the standing wave generated in the exhaust channel.

Specifically, in the present embodiment, as shown in FIG. 6A, the position of the antinode in sound pressure of the standing wave generated in the above-described exhaust channel is a point P3 at a distance of a length ⅔L from the coupling point P1 between the engine 71 and the exhaust manifold 73. Thus, the opening 19 of the sub-muffler 5 is provided in the point P3. Therefore, it is possible to suppress air column resonance in the exhaust system 1, and reduce exhaust noise.

(7) Seventh Embodiment

Next is a description of a seventh embodiment. The exhaust system 1 shown in FIG. 6B includes the same components as those of the exhaust system 1 described in the above sixth embodiment. However, in the seventh embodiment, the double-wall pipe 15 forming the sub-muffler 5 is disposed such that the second end 15B is on the upstream side of the exhaust channel and the first end 15A is on the downstream side of the exhaust channel. That is, in the seventh embodiment, the sub-muffler 5 is disposed in a reverse orientation to that of the sixth embodiment. Even with the sub-muffler 5 disposed in such orientation, the arrangement place of the sub-muffler 5 is adjusted in consideration of the range in which air column resonance occurs, so that the opening 19 is provided in an optimum position.

Figure 6B:
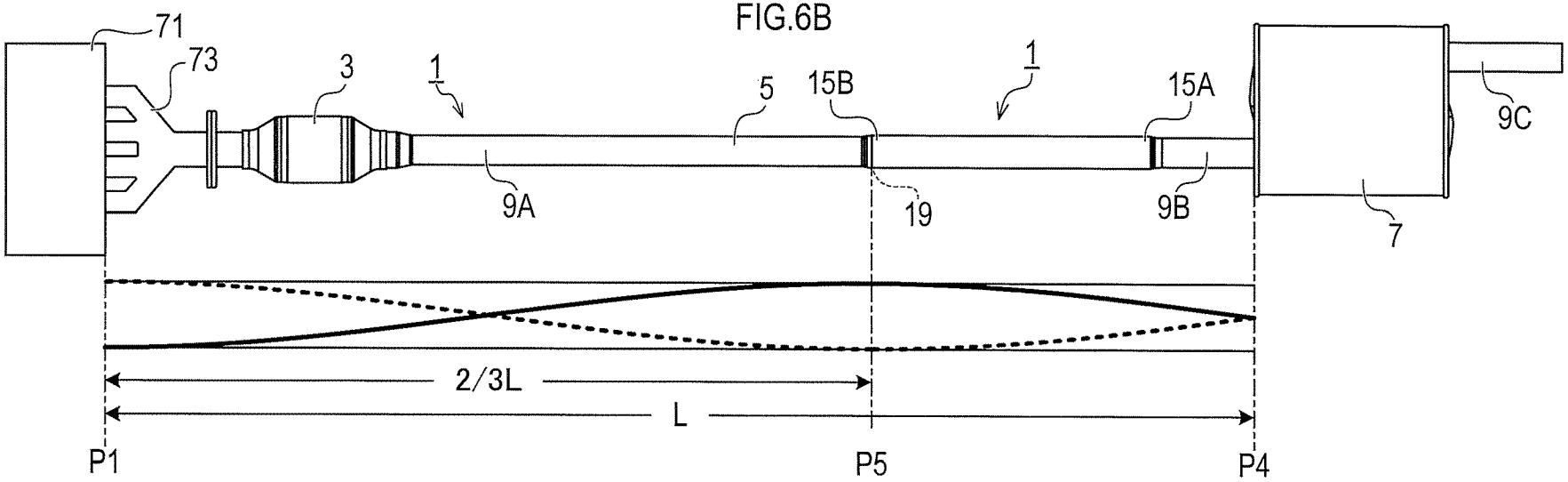
FIG. 6B is an explanatory view showing an exhaust system of a seventh embodiment, a range in which air column resonance occurs in the exhaust system, and positions of antinodes and nodes in sound pressure of a standing wave generated in the range.

In the exhaust system 1 of the seventh embodiment, resonance sound caused by air column resonance is generated in an exhaust channel from the coupling point P1 between the engine 71 and the exhaust manifold 73 to a coupling point P4 between the pipe member 9B and the main muffler 7 (exhaust channel having the length L shown in FIG. 6B). That is, the range in which air column resonance occurs can vary depending on the configuration of the exhaust system 1. In this case, the opening 19 is provided in a position P5 at a distance of the length ⅔L from the coupling point P1 between the engine 71 and the exhaust manifold 73. The arrangement place of the sub-muffler 5 is optimized based on the position of the opening 19. Even with the sub-muffler 5 disposed in such position in the orientation as described above, it is possible to suppress air column resonance in the exhaust system 1, and reduce exhaust noise.

(8) Eighth Embodiment

An eighth embodiment will now be described. The exhaust system 1 shown in FIG. 7A includes the same components as those of the exhaust system 1 described in the above seventh embodiment. However, in the eighth embodiment, under assumption of a standing wave of the third-order mode, the sub-muffler 5 is arranged so that the opening 19 is provided in a position corresponding to an antinode in sound pressure of the standing wave.

Figure 7A:
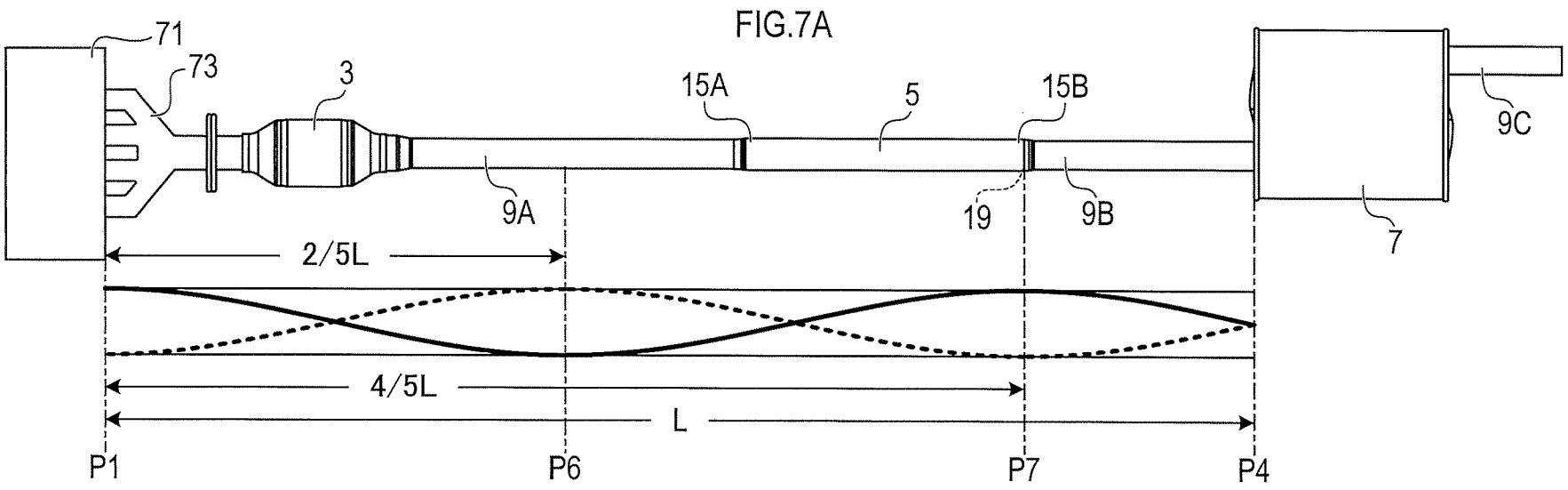
FIG. 7A is an explanatory view showing an exhaust system of an eighth embodiment, a range in which air column resonance occurs in the exhaust system, and positions of antinodes and nodes in sound pressure of a standing wave generated in the range.

Specifically, as shown in FIG. 7A, in a standing wave of the third-order mode, a position of the antinode in sound pressure of the standing wave is in a point P6 at a distance of a length ⅖L, and a point P7 at a distance of ⅘L, from the coupling point P1 between the engine 71 and the exhaust manifold 73. Therefore, in the eighth embodiment, the opening 19 of the sub-muffler 5 is provided in the point P7 at a distance of ⅘L. Even with the sub-muffler 5 disposed in such position, it is possible to suppress air column resonance in the exhaust system 1, and reduce exhaust noise.

(9) Ninth Embodiment

Figure 7B:
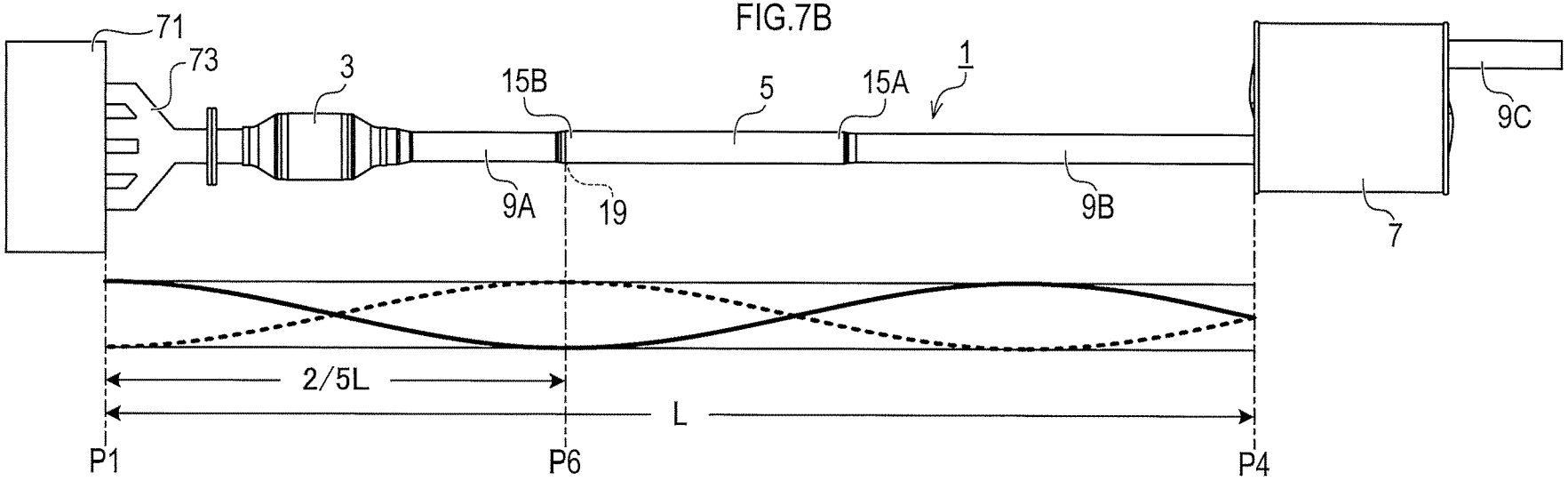
FIG. 7B is an explanatory view showing an exhaust system of a ninth embodiment, a range in which air column resonance occurs in the exhaust system, and positions of antinodes and nodes in sound pressure of a standing wave generated in the range.

Next is a description of a ninth embodiment. The exhaust system 1 shown in FIG. 7B includes the same components as those of the exhaust system 1 described in the above eighth embodiment. In the ninth embodiment, the standing wave is of the third-order mode, as in the eighth embodiment. However, in the ninth embodiment, the opening 19 of the sub-muffler 5 is provided in the point P6 at a distance of the length ⅖L from the coupling point between the engine 71 and the exhaust manifold 73. The orientation of the sub-muffler 5 is the same as that in the seventh embodiment. Even with the sub-muffler 5 disposed in such position, it is possible to suppress air column resonance in the exhaust system 1, and reduce exhaust noise.

(10) Tenth Embodiment

Figure 8C:
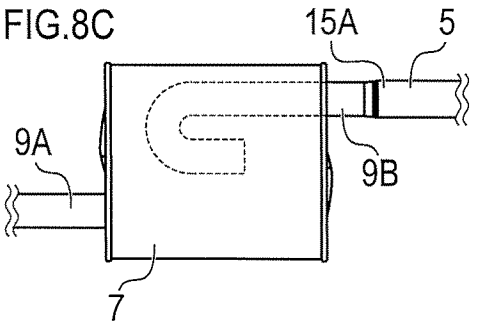
FIG. 8C is an explanatory view showing a modified example of a configuration of part of the exhaust system of the tenth embodiment.
Figure 8A:
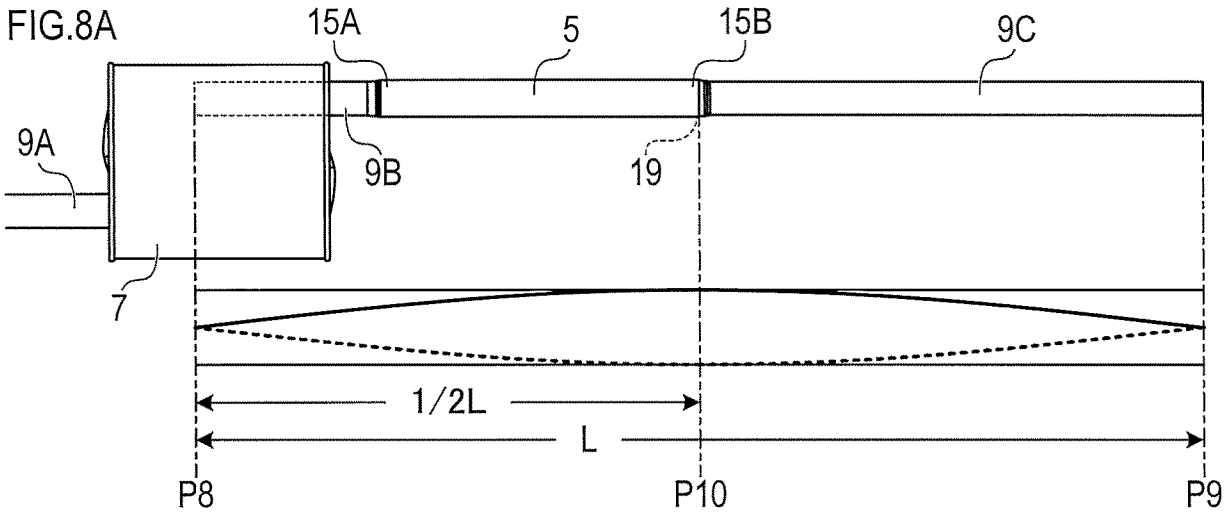
FIG. 8A is an explanatory view showing an exhaust system of a tenth embodiment, a range in which air column resonance occurs in the exhaust system, and positions of antinodes and nodes in sound pressure of a standing wave generated in the range.

Next is a description of a tenth embodiment. The exhaust system 1 shown in FIG. 8A includes the same components as those of the exhaust system 1 described in the above sixth embodiment. FIG. 8A shows part of the configuration of the exhaust system 1. In the tenth embodiment, the sub-muffler 5 is arranged at a position closer to the downstream side in the exhaust flow direction than the main muffler 7.

In the tenth embodiment, resonance sound caused by air column resonance is generated in an exhaust channel from an end P8 of the pipe member 9B to an open end P9 of the pipe member 9C closer to the downstream side in the exhaust flow direction than the sub-muffler 5 (exhaust channel having the length L shown in FIG. 8A). Also in the tenth embodiment, the sub-muffler 5 is arranged so that the opening 19 is provided in a position corresponding to an antinode in sound pressure of a standing wave generated in the exhaust channel.

Specifically, as shown in FIG. 8A, the position of the antinode in sound pressure of the standing wave generated in the exhaust channel described above is in a point P10 at a distance of a length ½L from the end P8 of the pipe member 9B. The opening 19 of the sub-muffler 5 is provided in the point P10. Thus, it is possible to suppress air column resonance in the exhaust system 1, and reduce exhaust noise.

(11) Eleventh Embodiment

An eleventh embodiment will now be described. In the exhaust system 1 shown in FIG. 8B, as in the above tenth embodiment, the sub-muffler 5 is disposed at a position closer to the downstream side in the exhaust flow direction than the main muffler 7. In the eleventh embodiment, resonance sound caused by air column resonance is generated in the exhaust channel from an end P11 of the pipe member 9B to an open end P12 of the pipe member 9C closer to the downstream side in the exhaust flow direction than the sub-muffler 5 (exhaust channel having the length L shown in FIG. 8B). However, in the eleventh embodiment, under assumption of a standing wave of the second-order mode, the sub-muffler 5 is arranged so that the opening 19 is provided in a position corresponding to an antinode in sound pressure of the standing wave.

Figure 8B:
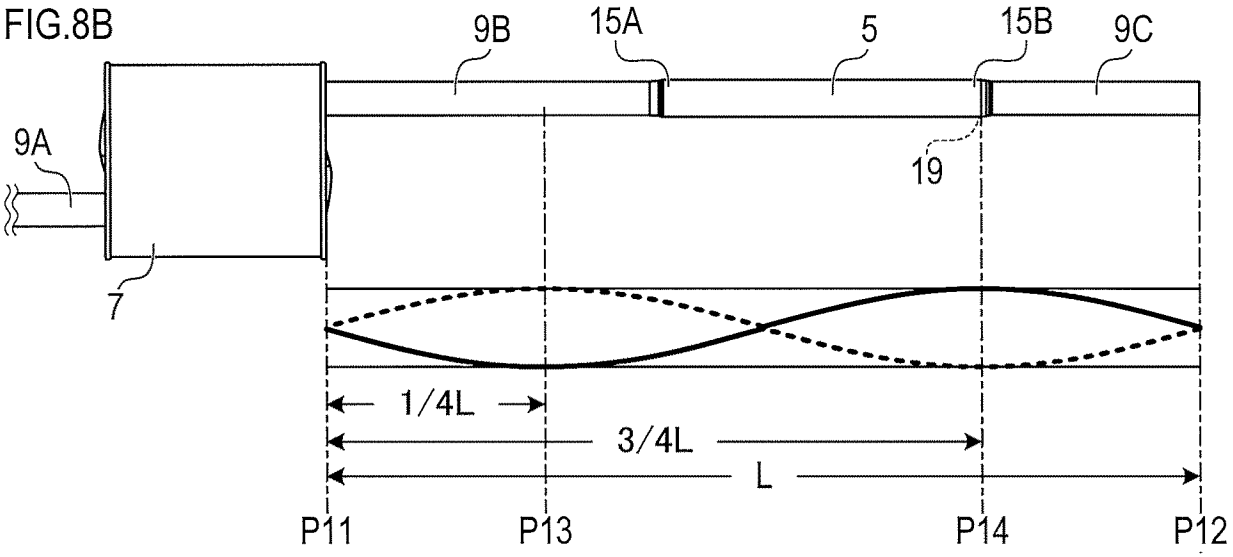
FIG. 8B is an explanatory view showing an exhaust system of an eleventh embodiment, a range in which air column resonance occurs in the exhaust system, and positions of antinodes and nodes in sound pressure of a standing wave generated in the range.

Specifically, as shown in FIG. 8B, in the standing wave of the second-order mode, the position of the antinode in sound pressure of the standing wave is in a point P13 at a distance of a length ¼L, and a point P14 at a distance of ¾L, from the end P11 of the pipe member 9B. Therefore, in the eleventh embodiment, the opening 19 of the sub-muffler 5 is provided in the point P14 at a distance of ¾L. Even with the sub-muffler 5 disposed in such position, it is possible to suppress air column resonance in the exhaust system 1, and reduce exhaust noise. The opening 19 of the sub-muffler 5 may be provided in the point P13 at a distance of ¼L.

(12) Twelfth Embodiment

A twelfth embodiment will now be described. In the first embodiment described above, the cavity between the inner pipe 11 and the outer pipe 13 is closed at the first end 15A, and the opening 19 is provided between the inner pipe 11 and the outer pipe 13 at the second end 15B. In a sub-muffler 76 shown in FIGS. 9A, 9B and 9C as the twelfth embodiment, openings are provided on both the first end 15A and second end 15B.

In the sub-muffler 76 shown in FIGS. 9A, 9B and 9C, a wire mesh 77 is inserted between the inner pipe 11 and the outer pipe 13 at the first end 15A. However, as shown in FIG. 9C, the wire mesh 77 is shaped such that a part of the wire mesh 77 in a circumferential direction is discontinuous, and an opening 78 is formed by the discontinuous portion.

The size and shape of the opening 78 can be adjusted to an extent that the function of the resonance chamber 17A defined between the inner pipe 11 and the outer pipe 13 is not impaired. Such adjustment enables adjustment of frequency calculated as a characteristic of a Helmholtz resonator. Resonance frequency of a Helmholtz resonator, as described in the first embodiment, can be varied by adjusting a resonance pipe sectional area, a resonance pipe length, and a resonance chamber volume, and the like, and can be also varied by adjusting the size and shape of the opening 78. The adjustable opening 78 increases adjusting means of resonant frequency in a Helmholtz resonator, thereby increasing a degree of freedom in making such adjustments.

If an opening is provided in both the first end 15A and the second end 15B, the exhaust can flow also into the cavity between the inner pipe 11 and the outer pipe 13. Thus, two systems of exhaust channels are formed, one on the outer-circumferential side and the other on the inner-circumferential side of the inner pipe 11. In this case, even if one of the exhaust channels is clogged, it is possible to avoid the exhaust channels from being completely closed by the other exhaust channel if not clogged.

Thus, for example, even if one of the exhaust channels is blocked with ice under a repeated phenomenon of water accumulation and freezing in an exhaust pipe in a cold district or the like, exhaust gas can be discharged through the other exhaust channel. Therefore, the sub-muffler 76 may be disposed in a position where water can easily accumulate due to the curved shape of the exhaust pipe. Then, in addition to a muffling effect, measures against frozen water in the exhaust pipe can also be achieved.

(13) Thirteenth Embodiment

A thirteenth embodiment will now be described. A sub-muffler 81 shown in FIGS. 9A, 9B and 9C has a recess which is similar to that at the second end 15B, and an opening 85 also at the first end 15A on the outer circumference of the inner pipe 11. The size and shape of this opening 85 can also be adjusted to an extent that the function of the resonance chamber 17A defined between the inner pipe 11 and the outer pipe 13 is not impaired. Such adjustment enables adjustment of frequency calculated as a characteristic of a Helmholtz resonator. Also in the present embodiment, two systems of exhaust channels are ensured as in the twelfth embodiment.

(14) Fourteenth Embodiment

A fourteenth embodiment will now be described. A sub-muffler 86 illustrated in the fourteenth embodiment is different from the sub-muffler 81 illustrated in the thirteenth embodiment in that the number of openings 19 provided on the second end 15B, but is configured in the same manner as in the thirteenth embodiment in other respects.

That is, even the sub-muffler 86 shown in FIGS. 10A, 10B and 10C has a recess and an opening 88 at the first end 15A on the outer circumference of the inner pipe 11. The size and shape of the opening 88 can be also adjusted to an extent that the function of the resonance chamber 17A defined between the inner pipe 11 and the outer pipe 13 is not impaired. Such adjustment enables adjustment of frequency calculated as a characteristic of a Helmholtz resonator. Also in the present embodiment, two systems of exhaust channels are ensured as in the twelfth embodiment.

(15) Fifteenth Embodiment

A fifteenth embodiment will now be described. The sub-muffler 91 illustrated in FIGS. 10D, 10E and 10F as the fifteenth embodiment is different from the sub-muffler 81 illustrated in the thirteenth embodiment in the shape of the first end 15A, but is configured in the same manner as in the thirteenth embodiment in other respects. The sub-muffler 91 shown in FIGS. 10D, 10E and FIG. 10F has a recess and an opening 95 at the first end 15A on the outer circumference of the inner pipe 11. The size and shape of the opening 95 can be also adjusted to an extent that the function of the resonance chamber 17A defined between the inner pipe 11 and the outer pipe 13 is not impaired. Such adjustment enables adjustment of frequency calculated as a characteristic of a Helmholtz resonator. Also in the present embodiment, two systems of exhaust channels are ensured as in the twelfth embodiment.

(16) Other Embodiments

Although the muffler of the present disclosure has been described by way of example embodiments, the above-described embodiments are merely illustrated as one aspect of the present disclosure. That is, the present disclosure is not limited to the example embodiments described above, and can be implemented in various forms without departing from the scope and technical idea of the present disclosure.

For example, the above embodiments illustrate the exhaust system including a single sub-muffler or two sub-mufflers as an example. There may be three or more sub-mufflers.

The above embodiments illustrated some specific examples regarding the cavity to become the resonance pipe 17B. The cavity may have other cross-sectional shapes than those in the above examples if the cavity can function as the resonance pipe 17B.

In the above embodiments, in order to suppress resonance sound due to air column resonance, the opening of the sub-muffler 5 is provided at a position corresponding to the antinode in sound pressure of the standing wave under assumption of a standing wave from the first-order mode to third-order mode. The sub-muffler 5 may be arranged under assumption of a standing wave other than those in the above-described examples. For example, the opening 19 may be provided in a position at a distance of a length ⅙L or ⅚L, from one end of a range of the length L in which a standing wave is generated, under assumption of a standing wave of the third-order mode in the configuration of such as the tenth embodiment and the eleventh embodiment described above. The standing wave may be of the fourth-order mode or more.

Further, the above embodiments show that the catalytic converter 3 and the sub-muffler 5 (or the first sub-muffler 5A and the second sub-muffler 5B) are arranged straight through the pipe member 9. Each of the sub-muffler 5 and the pipe member 9 may be bent. For example, FIG. 8A shows an example of the pipe member 9B extending straight inside the main muffler 7. As shown in FIG. 8C, there is also a case in which a pipe member 9 is curved inside the main muffler 7. In this case as well, the configuration of the present disclosure may be employed.

Among the plurality of components forming the exhaust system, if some components are curved, the pipe line as the whole exhaust system is also curved in some portions. Even in such case, air column resonance can occur in the curved pipe line. Thus, the arrangement position of the sub-muffler 5 may be set so that the opening 19 is provided in the position corresponding to the antinode in sound pressure of the standing wave.

In the above embodiments, a portion made up from a single component may be configured in combination of a plurality of components. A portion made up from a plurality of components may be configured by a single component. Some of the components of the above embodiments may be omitted. Further, at least some of the components of the above embodiments may be added to or substituted for the components of the other of the above embodiments.

Besides the sub-muffler described above, the present disclosure can be implemented in various forms, such as an exhaust system including the above sub-muffler as a component, an exhaust method using the sub-muffler described above, and the like.

(17) Supplemental Description

As is apparent from the example embodiments described above, the muffler of the present disclosure may further include components as listed below.

First, the muffler of the present disclosure may be configured such that the inner pipe is shaped to have a large diameter portion having a maximum outer diameter as a first diameter, and a small diameter portion having a second diameter as a maximum outer diameter smaller than the first diameter, a resonance chamber which corresponds to a part of the cavity is provided between an outer-circumferential surface of the small diameter portion and an inner-circumferential surface of an outer pipe, the large-diameter portion is disposed at the second end, a resonance pipe corresponding to a part of the cavity is formed between a part of an outer-circumferential surface of the large diameter portion and the inner-circumferential surface of the outer pipe, an opening is provided at one end of the resonance pipe, the resonance pipe leads to the exhaust channel through the opening, the resonance chamber leads to the exhaust channel through the resonance pipe, so that the resonance pipe and the resonance chamber function as a Helmholtz resonator.

According to the muffler configured as above, an opening can be provided at an end of the double-wall pipe to form a resonance pipe extending in the same direction as an axial direction of the double-wall pipe. Therefore, compared to the case of a through hole penetrating the inner pipe in a radial direction as the resonance pipe, an axial length of the resonance pipe can be easily lengthened. Accordingly, while ensuring a sufficient noise suppressing effect, resonance frequency can be easily set lower.

Further, in the muffler of the present disclosure, the outer pipe may be shaped so that an outer diameter in a range from the first end to the second end is equal to or smaller than the outer diameter at the second end.

The muffler configured as above has no portion with a larger outer diameter of the double-wall pipe than that at the second end, and thus can be also disposed in a narrower arrangement place, as compared to a muffler having a portion with a larger outer diameter of the double-wall pipe than that at the second end.

Also, in a case in which air column resonance occurs in an exhaust channel formed by exhaust channel forming components including a muffler, the muffler of the present disclosure may include an opening in a position corresponding to an antinode in sound pressure of a standing wave generated in the exhaust channel.

The muffler configured as such can suppress generation of resonance sound due to air column resonance, and reduce exhaust noise as compared to a muffler arranged in another position.

The invention claimed is:

1. A muffler comprising:

an inner pipe having a tubular shape, and an outer pipe having a tubular shape, the inner pipe being disposed on an inner- circumferential side of the outer pipe, the outer pipe forming a double-wall pipe with the inner pipe, one of a first end of the double-wall pipe or a second end of the double-wall pipe being continuous to a first channel on an upstream side in an exhaust flow direction, and the other of the first end of the double-wall pipe or the second end of the double-wall pipe being continuous to a second channel on a downstream side in the exhaust flow direction, thereby forming an exhaust channel coupling the first channel and the second channel via the inner pipe, a cavity being provided between the outer pipe and the inner pipe, the second end having an opening between the inner pipe and the outer pipe, the cavity being configured so as to communicate with the exhaust channel via the opening, the inner pipe having a first range and a second range, an outer side surface of the inner pipe is located at the same position as a reference in the first range, and the outer side surface of the inner pipe is disposed on an inner side relative to the reference in the second range, the reference being a position of an inner side surface of the outer pipe, the outer side surface of the inner pipe reaching an edge of the second end in each of the first range and the second range, the inner pipe and the outer pipe being disposed at a position where the outer side surface of the inner pipe and the inner side surface of the outer pipe are in contact with each other so as to close a space between the inner pipe and the outer pipe, in the first range, a part of the cavity being formed between the outer side surface of the inner pipe and the inner side surface of the outer pipe, and the opening being formed in a portion where the second range reaches the edge of the second end, in the second range;

wherein:

the inner pipe includes a large diameter portion having a first diameter, and includes a small diameter portion having a second diameter that is smaller than the first diameter, a part of the cavity is formed between an outer side surface of the small diameter portion and the inner side surface of the outer pipe, the large diameter portion is disposed at the second end and includes the first range and the second range, and in the second range, includes the part of the cavity formed between the outer side surface of the large diameter portion and the inner side surface of the outer pipe;

the inner pipe including an inner pipe small diameter portion forming the first end, an outer diameter of the inner pipe becoming smaller in the inner pipe small diameter portion, an inner pipe large diameter portion forming the second end, the outer diameter of the inner pipe becoming larger in the inner pipe large diameter portion, and an inner pipe enlarged diameter portion provided between the inner pipe small diameter portion and the inner pipe large diameter portion, the outer diameter of the inner pipe gradually increasing from the inner pipe small diameter portion to the inner pipe large diameter portion in the inner pipe enlarged diameter portion, and the inner pipe large diameter portion having a length larger than a combined length of the inner pipe small diameter portion and the inner pipe enlarged diameter portion, in the exhaust flow direction.

2. The muffler according to claim 1, wherein a resonance chamber corresponds to the part of the cavity formed between the outer side surface of the small diameter portion and the inner side surface of the outer pipe, wherein a resonance pipe corresponding to a part of the cavity is formed between an outer side surface of the large diameter portion and the inner side surface of the outer pipe, and wherein the opening is provided at one end of the resonance pipe, the resonance pipe communicates with the exhaust channel via the opening, and the resonance chamber communicates with the exhaust channel via the resonance pipe, whereby the resonance pipe and the resonance chamber are configured to function as a Helmholtz resonator.

3. The muffler according to claim 1, wherein an outer diameter of the outer pipe in a range from the first end to the second end is equal to or smaller than an outer diameter of the outer pipe at the second end.

4. The muffler according to claim 1, wherein the opening is provided at a position corresponding to an antinode in sound pressure of a standing wave generated in an exhaust channel formed by exhaust channel forming components including the muffler, if air column resonance occurs in the exhaust channel.

5. The muffler according to claim 1, wherein the outer side surface of the inner pipe and the inner side surface of the outer pipe are in contact with each other, and the inner pipe and the outer pipe are joined to each other, in the first range.

6. The muffler according to claim 1, wherein the cavity is provided at least at a lower side of the inner pipe.

7. A muffler comprising:

an inner pipe having a tubular shape; and an outer pipe having a tubular shape, the inner pipe being disposed on an inner-circumferential side of the outer pipe, the outer pipe forming a double-wall pipe with the inner pipe, one of a first end of the double-wall pipe or a second end of the double-wall pipe being continuous to a first channel on an upstream side in an exhaust flow direction, and the other of the first end of the double-wall pipe or the second end of the double-wall pipe being continuous to a second channel on a downstream side in the exhaust flow direction, thereby forming an exhaust channel coupling the first channel and the second channel via the inner pipe, a cavity being provided between the outer pipe and the inner pipe, the second end having an opening between the inner pipe and the outer pipe, the cavity being configured to communicate with the exhaust channel via the opening, the inner pipe having a first range and a second range, an outer side surface of the inner pipe being located at the same position as a reference in the first range, and the outer side surface of the inner pipe being disposed on an inner side relative to the reference in the second range, the reference being a position of an inner side surface of the outer pipe, the outer side surface of the inner pipe reaching an edge of the second end in each of the first range and the second range, the inner pipe and the outer pipe being disposed at a position where the outer side surface of the inner pipe and the inner side surface of the outer pipe are in contact with each other so as to close a space between the inner pipe and the outer pipe, in the first range, a part of the cavity being formed between the outer side surface of the inner pipe and the inner side surface of the outer pipe, and the opening being formed in a portion where the second range reaches the edge of the second end, in the second range, the outer pipe including an outer pipe small diameter portion forming the first end, an outer diameter of the outer pipe becoming smaller in the outer pipe small diameter portion, an outer pipe large diameter portion forming the second end, the outer diameter of the outer pipe becoming larger in the outer pipe large diameter portion, and an outer pipe enlarged diameter portion provided between the outer pipe small diameter portion and the outer pipe large diameter portion, the outer diameter of the outer pipe gradually increasing from the outer pipe small diameter portion to the outer pipe large diameter portion in the outer pipe enlarged diameter portion, the outer pipe large diameter portion having a length larger than a combined length of the outer pipe small diameter portion and the outer pipe enlarged diameter portion, in the exhaust flow direction, the inner pipe including an inner pipe small diameter portion forming the first end, an outer diameter of the inner pipe becoming smaller in the inner pipe small diameter portion, an inner pipe large diameter portion forming the second end, the outer diameter of the inner pipe becoming larger in the inner pipe large diameter portion, and an inner pipe enlarged diameter portion provided between the inner pipe small diameter portion and the inner pipe large diameter portion, the outer diameter of the inner pipe gradually increasing from the inner pipe small diameter portion to the inner pipe large diameter portion in the inner pipe enlarged diameter portion, the inner pipe large diameter portion having a length larger than a combined length of the inner pipe small diameter portion and the inner pipe enlarged diameter portion, in the exhaust flow direction, an inner side surface of the outer pipe small diameter portion and an outer side surface of the inner pipe small diameter portion being in contact with each other over the entire circumference, an inner side surface of the outer pipe large diameter portion and an outer side surface of the inner pipe large diameter portion being in contact with each other in some area, which is the first range, and form the cavity between each other in an other area, which is the second range, differing from the some area, and a part of the outer side surface of the inner pipe large diameter portion being disposed on an inner-circumferential side relative to a reference in a portion where the cavity is formed, the reference being a position of the inner side surface of the outer pipe large diameter portion.

8. The muffler according to claim 1, wherein the outer pipe is configured so that a diameter between the first end and the second end is the same over the entire circumference, wherein the inner pipe includes an inner pipe small diameter portion forming the first end, an outer diameter of the inner pipe becoming smaller in the inner pipe small diameter portion, an inner pipe large diameter portion forming the second end, the outer diameter of the inner pipe becoming larger in the inner pipe large diameter portion, and an inner pipe enlarged diameter portion provided between the inner pipe small diameter portion and the inner pipe large diameter portion, the outer diameter of the inner pipe gradually increasing from the inner pipe small diameter portion to the inner pipe large diameter portion in the inner pipe enlarged diameter portion, wherein a wire mesh is inserted between the inner side surface of the outer pipe and the outer side surface of the inner pipe over the entire circumference in the vicinity of the first end, so as to close the space between the inner pipe and the outer pipe, wherein the inner side surface of the outer pipe and an outer side surface of the inner pipe large diameter portion are in contact with each other in some area, which is the first range, and form the cavity between each other in an other area, which is the second range, differing from the some area, and a part of the outer side surface of the inner pipe large diameter portion is disposed on the inner-circumferential side relative to the reference in a portion where the cavity is formed.

9. The muffler according to claim 1, wherein the outer pipe is configured so that a diameter between the first end and the second end is the same over the entire circumference, wherein the inner pipe is configured so that a diameter between the first end and the second end is the same over the entire circumference, wherein the inner side surface of the outer pipe and an outer side surface of the inner pipe are in contact with each other in some area, which is the first range, and form the cavity between each other in an other area differing from the some area, which is the second range, and a part of the outer side surface of the inner pipe is disposed on the inner-circumferential side relative to the reference in a portion where the cavity is formed, wherein a wire mesh is inserted between the inner side surface of the outer pipe and the outer side surface of the inner pipe in the vicinity of the first end, so as to close the space between the inner pipe and the outer pipe.

10. The muffler according to claim 1, wherein the outer pipe is configured so that a diameter between the first end and the second end is the same over the entire circumference, wherein the inner pipe includes an inner pipe small diameter portion forming the first end, an outer diameter of the inner pipe becoming smaller in the inner pipe small diameter portion, an inner pipe large diameter portion forming the second end, the outer diameter of the inner pipe becoming larger in the inner pipe large diameter portion, and an inner pipe enlarged diameter portion provided between the inner pipe small diameter portion and the inner pipe large diameter portion, the outer diameter of the inner pipe gradually increasing from the inner pipe small diameter portion to the inner pipe large diameter portion in the inner pipe enlarged diameter portion, wherein a wire mesh having a shape partially discontinued in a circumferential direction is inserted between the inner side surface of the outer pipe and the outer side surface of the inner pipe over the entire circumference in the vicinity of the first end, so as to form an opening by the partially discontinued portion, wherein the inner side surface of the outer pipe and an outer side surface of the inner pipe large diameter portion are in contact with each other in some area, which is the first range, and form the cavity between each other in an other area, which is the second range, differing from the some area, and a part of the outer side surface of the inner pipe large diameter portion is disposed on the inner-circumferential side relative to the reference in a portion where the cavity is formed.

11. The muffler according to claim 1, wherein the outer pipe is configured so that a diameter between the first end and the second end is the same over the entire circumference, wherein the inner pipe includes a first inner pipe large diameter portion forming the first end, an outer diameter of the inner pipe becoming larger in the first inner pipe large diameter portion, a second inner pipe large diameter portion forming the second end, the outer diameter of the inner pipe becoming larger in the second inner pipe large diameter portion, an inner pipe small diameter portion, the outer diameter of the inner pipe becoming smaller in the inner pipe small diameter portion, a first inner pipe enlarged diameter portion provided between the inner pipe small diameter portion and the first inner pipe large diameter portion, the outer diameter of the inner pipe gradually increasing from the inner pipe small diameter portion to the first inner pipe large diameter portion in the first inner pipe enlarged diameter portion, and a second inner pipe enlarged diameter portion provided between the inner pipe small diameter portion and the second inner pipe large diameter portion, the outer diameter of the inner pipe gradually increasing from the inner pipe small diameter portion to the second inner pipe large diameter portion in the second inner pipe enlarged diameter portion, wherein the inner pipe small diameter portion has a length larger than a combined length of the first inner pipe large diameter portion, the second inner pipe large diameter portion, the first inner pipe enlarged diameter portion, and the second inner pipe enlarged diameter portion, in the exhaust flow direction, wherein the inner side surface of the outer pipe and an outer side surface of the first inner pipe large diameter portion are in contact with each other in some area, which is the first range, and form the cavity between each other in an other area, which is the second range, differing from the some area, and a part of the outer side surface of the first inner pipe large diameter portion is disposed on the inner-circumferential side relative to the reference in a portion where the cavity is formed, wherein the inner side surface of the outer pipe and an outer side surface of the second inner pipe large diameter portion are in contact with each other at a part of an area, which is the first range, and form the cavity between each other at a remaining part of an area, which is the second range, and a part of the outer side surface of the second inner pipe large diameter portion is disposed on the inner-circumferential side relative to the reference in the portion where the cavity is formed.

12. The muffler according to claim 1, wherein the outer pipe includes an outer pipe small diameter portion forming the first end, an outer diameter of the outer pipe becoming smaller in the outer pipe small diameter portion, an outer pipe large diameter portion forming the second end, the outer diameter of the outer pipe becoming larger in the outer pipe large diameter portion, and an outer pipe enlarged diameter portion provided between the outer pipe small diameter portion and the outer pipe large diameter portion, the outer diameter of the outer pipe gradually increasing from the outer pipe small diameter portion to the outer pipe large diameter portion in the outer pipe enlarged diameter portion, wherein the outer pipe large diameter portion has a length larger than a combined length of the outer pipe small diameter portion and the outer pipe enlarged diameter portion, in the exhaust flow direction, wherein the inner pipe includes an inner pipe small diameter portion forming the first end, an outer diameter of the inner pipe becoming smaller in the inner pipe small diameter portion, an inner pipe large diameter portion forming the second end, the outer diameter of the inner pipe becoming larger in the inner pipe large diameter portion, and an inner pipe enlarged diameter portion provided between the inner pipe small diameter portion and the inner pipe large diameter portion, the outer diameter of the inner pipe gradually increasing from the inner pipe small diameter portion to the inner pipe large diameter portion in the inner pipe enlarged diameter portion, wherein the inner pipe large diameter portion has a length larger than a combined length of the inner pipe small diameter portion and the inner pipe enlarged diameter portion, in the exhaust flow direction, wherein an inner side surface of the outer pipe small diameter portion and an outer side surface of the inner pipe small diameter portion are in contact with each other in some area, and form the cavity between each other in an other area differing from the some area, and a part of the outer side surface of the inner pipe small diameter portion is disposed on an inner circumferential side relative to a reference in a portion where the cavity is formed, the reference being a position of the inner side surface of the outer pipe small diameter portion, wherein an inner side surface of the outer pipe large diameter portion and an outer side surface of the inner pipe large diameter portion are in contact with each other in some area, and form the cavity between each other in an other area differing from the some area, and a part of the outer side surface of the inner pipe large diameter portion is disposed on an inner-circumferential side relative to a reference in a portion where the cavity is formed, the reference being a position of the inner side surface of the outer pipe large diameter portion.

13. The muffler according to claim 2, wherein an outer diameter of the outer pipe in a range from the first end to the second end is equal to or smaller than an outer diameter of the outer pipe at the second end.

14. The muffler according to claim 2, wherein the opening is provided at a position corresponding to an antinode in sound pressure of a standing wave generated in an exhaust channel formed by exhaust channel forming components including the muffler, if air column resonance occurs in the exhaust channel.

15. The muffler according to claim 3, wherein the opening is provided at a position corresponding to an antinode in sound pressure of a standing wave generated in an exhaust channel formed by exhaust channel forming components including the muffler, if air column resonance occurs in the exhaust channel.

16. The muffler according to claim 13, wherein the opening is provided at a position corresponding to an antinode in sound pressure of a standing wave generated in an exhaust channel formed by exhaust channel forming components including the muffler, if air column resonance occurs in the exhaust channel.

17. The muffler according to claim 2, wherein the outer side surface of the inner pipe and the inner side surface of the outer pipe are in contact with each other, and the inner pipe and the outer pipe are joined to each other, in the first range.

18. The muffler according to claim 3, wherein the outer side surface of the inner pipe and the inner side surface of the outer pipe are in contact with each other, and the inner pipe and the outer pipe are joined to each other, in the first range.

19. The muffler according to claim 4, wherein the outer side surface of the inner pipe and the inner side surface of the outer pipe are in contact with each other, and the inner pipe and the outer pipe are joined to each other, in the first range.

20. The muffler according to claim 13, wherein the outer side surface of the inner pipe and the inner side surface of the outer pipe are in contact with each other, and the inner pipe and the outer pipe are joined to each other, in the first range.

21. The muffler according to claim 14, wherein the outer side surface of the inner pipe and the inner side surface of the outer pipe are in contact with each other, and the inner pipe and the outer pipe are joined to each other, in the first range.

22. The muffler according to claim 15, wherein the outer side surface of the inner pipe and the inner side surface of the outer pipe are in contact with each other, and the inner pipe and the outer pipe are joined to each other, in the first range.

23. The muffler according to claim 16, wherein the outer side surface of the inner pipe and the inner side surface of the outer pipe are in contact with each other, and the inner pipe and the outer pipe are joined to each other, in the first range.

24. The muffler according to claim 2, wherein the cavity is provided at least at a lower side of the inner pipe.

25. The muffler according to claim 3, wherein the cavity is provided at least at a lower side of the inner pipe.

26. The muffler according to claim 4, wherein the cavity is provided at least at a lower side of the inner pipe.

27. The muffler according to claim 5, wherein the cavity is provided at least at a lower side of the inner pipe.

28. The muffler according to claim 13, wherein the cavity is provided at least at a lower side of the inner pipe.

29. The muffler according to claim 14, wherein the cavity is provided at least at a lower side of the inner pipe.

30. The muffler according to claim 15, wherein the cavity is provided at least at a lower side of the inner pipe.

31. The muffler according to claim 16, wherein the cavity is provided at least at a lower side of the inner pipe.

32. The muffler according to claim 17, wherein the cavity is provided at least at a lower side of the inner pipe.

33. The muffler according to claim 18, wherein the cavity is provided at least at a lower side of the inner pipe.

34. The muffler according to claim 19, wherein the cavity is provided at least at a lower side of the inner pipe.

35. The muffler according to claim 20, wherein the cavity is provided at least at a lower side of the inner pipe.

36. The muffler according to claim 21, wherein the cavity is provided at least at a lower side of the inner pipe.

37. The muffler according to claim 22, wherein the cavity is provided at least at a lower side of the inner pipe.

38. The muffler according to claim 23, wherein the cavity is provided at least at a lower side of the inner pipe.

39. A muffler comprising:

an inner pipe having a tubular shape, and an outer pipe having a tubular shape, the inner pipe being disposed on an inner-circumferential side of the outer pipe, the outer pipe forming a double-wall pipe with the inner pipe, one of a first end of the double-wall pipe or a second end of the double-wall pipe being continuous to a first channel on an upstream side in an exhaust flow direction, and the other of the first end of the double-wall pipe or the second end of the double-wall pipe being continuous to a second channel on a downstream side in the exhaust flow direction, thereby forming an exhaust channel coupling the first channel and the second channel via the inner pipe, a cavity being provided between the outer pipe and the inner pipe, the second end having an opening between the inner pipe and the outer pipe, the cavity being configured so as to communicate with the exhaust channel via the opening, in a circumferential area with presence of an inclusion to be held between an outer side surface of the inner pipe and an inner side surface of the outer pipe, the inner pipe having a reference that is a position of an inner side surface of the inclusion, whereas in a circumferential area with no presence of the inclusion, the inner pipe having a reference that is a position of the inner side surface of the outer pipe, the inner pipe having a first range where a position of the outer side surface of the inner pipe coincides with the reference, and the inner pipe having a second range where the outer side surface of the inner pipe is located inward relative to the reference, in the first range, the inclusion being held between the outer side surface of the inner pipe and the inner side surface of the outer pipe so as to close a space between the inner pipe and the outer pipe, in the second range, a part of the cavity being formed between the outer side surface of the inner pipe and the inner side surface of the outer pipe so as to form the opening at a position closer to the second end of the double-wall pipe in the second range, the inner pipe including a large diameter portion having a first diameter, and a small diameter portion having a second diameter that is smaller than the first diameter, the part of the cavity being formed between an outer side surface of the small diameter portion and the inner side surface of the outer pipe, the large diameter portion being disposed at the second end and including the first range and the second range, the part of the cavity being formed between an outer side surface of the large diameter portion and the inner side surface of the outer pipe in the second range, a resonance chamber, which corresponds to the part of the cavity, being formed between the outer side surface of the small diameter portion and the inner side surface of the outer pipe, in the second range, a resonance pipe, which corresponds to the part of the cavity, being formed between the outer side surface of the large diameter portion and the inner side surface of the outer pipe, and the opening provided at one end of the resonance pipe, the resonance pipe communicating with the exhaust channel via the opening, the resonance chamber communicating with the exhaust channel via the resonance pipe, whereby the resonance pipe and the resonance chamber being configured to function as a Helmholtz resonator.

* * * * *